US007024885B2

(12) United States Patent
Villalobos

(10) Patent No.: US 7,024,885 B2
(45) Date of Patent: Apr. 11, 2006

(54) SYSTEM AND METHOD FOR STORING GASES AT LOW TEMPERATURE USING A COLD RECOVERY SYSTEM

(75) Inventor: Carlos Eduardo Roldán Villalobos, Cartago (CR)

(73) Assignee: Consultoria SS-Soluciones Sociedad Anonima, Cartago (CR)

( * ) Notice: Subject to any disclaimer, the term of this patent is extended or adjusted under 35 U.S.C. 154(b) by 201 days.

(21) Appl. No.: 10/778,808

(22) Filed: Feb. 13, 2004

(65) Prior Publication Data

US 2005/0091991 A1 May 5, 2005

(30) Foreign Application Priority Data

Oct. 29, 2003 (CR) ..... 7129

(51) Int. Cl.
*F25J 1/00* (2006.01)

(52) U.S. Cl. ..... 62/606; 62/614

(58) Field of Classification Search ..... 62/606, 62/614

See application file for complete search history.

(56) References Cited

U.S. PATENT DOCUMENTS

| | | | | |
|---|---|---|---|---|
| 1,872,831 | A | 8/1932 | Siems | |
| 2,001,353 | A | 5/1935 | Sainikoff | |
| 2,147,109 | A | 2/1939 | Dana et al. | |
| 2,467,413 | A | 4/1949 | Wildhack | |
| 2,632,302 | A | 3/1953 | Steele | |
| 2,975,604 | A * | 3/1961 | McMahon | 62/614 |
| 3,034,309 | A * | 5/1962 | Muck | 65/50.2 |
| 3,191,395 | A | 6/1965 | Maher et al. | |
| 3,400,547 | A * | 9/1968 | Williams et al. | 62/50.1 |
| 3,410,099 | A * | 11/1968 | Hooker et al. | 62/606 |
| 3,616,652 | A | 11/1971 | Engel | |
| 3,733,838 | A | 5/1973 | Delahunty | |
| 4,575,386 | A * | 3/1986 | Hamers | 62/614 |
| 4,639,262 | A * | 1/1987 | Heichberger | 62/606 |
| 5,327,730 | A | 7/1994 | Myers et al. | |
| 5,537,822 | A | 7/1996 | Shnaid et al. | |
| 5,875,638 | A | 3/1999 | Tinsler | |
| 5,931,021 | A | 8/1999 | Shnaid et al. | |
| 6,138,473 | A * | 10/2000 | Boyer-Vidal | 62/613 |
| 6,289,692 | B1 | 9/2001 | Houser et al. | |

(Continued)

OTHER PUBLICATIONS

Iwata, Yukio et al., *Development of Bog Liquefaction System Utilizing Cold Energy Storage*, Poster 8-11, pps. 1-3.

(Continued)

*Primary Examiner*—William C. Doerrier
(74) *Attorney, Agent, or Firm*—Buchanan Ingersoll PC

(57) ABSTRACT

A system and process for liquefying or storing gases at low temperatures using a cold recovery system. The system and process includes a cold recovery system having at least one cold recovery vessel configured to receive a gas stream and cool the gas stream by passing the gas stream through a cold recovery vessel. The cold recovery vessels includes a cold recovery material configured to cool the cooled gas stream, wherein the gas stream is fed through the cold recovery vessel through a pipe immersed in the cold recovery material to produce a liquefied or low temperature gas. The liquefied or low temperature gas is stored in a liquid or low temperature state in a storage tank. When the liquefied or low temperature gas is released from the storage tank, the gas vaporizes or expands through the pipe and cools the cold recovery material.

42 Claims, 10 Drawing Sheets

U.S. PATENT DOCUMENTS 6,564,578 B1 5/2003 Fischer-Calderon
6,581,409 B1 6/2003 Wilding et al.
6,598,423 B1 * 7/2003 Emmer et al. ..... 62/614

OTHER PUBLICATIONS

Sawchuck et al., *A Gas Economy Brief*, LNG Technology.

* cited by examiner

SYSTEM AND METHOD FOR STORING GASES AT LOW TEMPERATURE USING A COLD RECOVERY SYSTEM

RELATED APPLICATIONS AND DISCLOSURES

This application is based upon information filed under the Disclosure Document Program on Sep. 3, 2003 as Disclosure Document Number 537976.

BACKGROUND

Because of its low density, most of the gases have been stored at high pressure or at low temperature as liquid cryogenic. When the gas is stored as a cryogenic liquid and it is going to be used as a gas at environmental temperature, the refrigeration delivered is not recovered. For this reason, when the tank containing the liquid cryogenic is going to be refilled, it is necessary to produce more cryogenic liquid using refrigeration systems. Additionally, because the liquefaction plant is not always at the same location where the gas is going to be used, it is often necessary to transport the gas in special trucks and to store the gas in cryogenic tanks. For this reason the cost of storing and transporting gas can be very high and the applications of some gases such as Natural Gas and Hydrogen have been limited.

For example, because of its clean burning qualities and convenience, natural gas has become widely used in recent years. However, many of the sources of natural gas are located in remote areas, great distances from any commercial markets for the gas. Sometimes a pipeline is available for transporting produced natural gas to a commercial market. When pipeline transportation is not feasible, produced natural gas is often processed into liquefied natural gas (which is called "LNG") for transport to market.

A commonly used technique for non-pipeline transport of gas involves liquefying the gas at or near the production site and then transporting the liquefied natural gas to market in specially-designed storage tanks aboard transport vessels. The natural gas is cooled and condensed to a liquid state to produce liquefied natural gas at substantially atmospheric pressure and at temperatures of about −162° C. (−260° F.) ("LNG"), thereby significantly increasing the amount of gas, which can be stored in a particular storage tank. Once an LNG transport vessel reaches its destination, the LNG is typically off-loaded into other storage tanks from which the LNG can then be vaporized as needed and transported as a gas to end users through pipelines or the like.

Typically, LNG refrigeration systems are quite expensive because so much refrigeration is needed to liquefy natural gas. Natural gas, which is predominantly methane, cannot be liquefied by simply increasing the pressure, as is the case with heavier hydrocarbons used for energy purposes. Although, methane can be liquefied at temperatures of about −162° C., methane gas can only be liquefied below its critical temperature regardless of the pressure applied. The critical temperature of methane is about −82.5° C. (−116.5° F.). In addition, since natural gas is a mixture of gases, it liquefies over a range of temperatures. For example the critical temperature of natural gas is between about −85° C. (−121° F.) and −62° C. (−80° F.). Typically, natural gas compositions at atmospheric pressure will liquefy in the temperature range between about −165° C. (−265° F.) and −155° C. (−247° F.). One of the significant costs involved in liquefying natural gases is the cost of the refrigeration equipment including the refrigeration material.

Although many refrigeration cycles have been used to liquefy natural gas, the three types most commonly used in LNG plants today are: (1) "expander cycle" which expands gas from a high pressure to a low pressure with a corresponding reduction in temperature, (2) "multi-component refrigeration cycle" which uses a multi-component refrigerant in specially designed exchangers, and (3) "cascade cycle" which uses multiple single component refrigerants in heat exchangers arranged progressively to reduce the temperature of the gas to a liquefaction temperature. Most natural gas liquefaction cycles use variations or combinations of these three basic types.

For example, the cascade system generally uses two or more refrigeration loops in which the expanded refrigerant from one stage is used to condense the compressed refrigerant in the next stage. Each successive stage uses a lighter, more volatile refrigerant which, when expanded, provides a lower level of refrigeration and is therefore able to cool to a lower temperature. To diminish the power required by the compressors, each refrigeration cycle is typically divided into several pressure stages (three or four stages is common). The pressure stages have the effect of dividing the work of refrigeration into several temperature steps. Propane, ethane, ethylene, and methane are commonly used refrigerants. Since propane can be condensed at a relatively low pressure by air coolers or water coolers, propane is normally the first-stage refrigerant. Ethane or ethylene can be used as the second-stage refrigerant. Condensing the ethane exiting the ethane compressor requires a low-temperature coolant. Propane provides this low-temperature coolant function. Similarly, if methane is used as a final-stage coolant, ethane is used to condense methane exiting the methane compressor. The propane refrigeration system is therefore used to cool the feed gas and to condense the ethane refrigerant and ethane is used to further cool the feed gas and to condense the methane refrigerant.

Accordingly, what is needed is a system and method of storing gases at low temperature using a cold recovery system where materials further known as cold recovery materials are subsequently cooled by expansion or vaporization of the previously stored liquefied gas or low temperature gas. In this way the cold recovery materials will have the required temperature to cool the gas when the tank is refilled.

SUMMARY

In accordance with one embodiment, a system for storing gases at low temperature, the system including a compressor configured to receive a gas stream and produce a compressed gas stream; a heat exchanger configured to receive the compressed gas stream and produce a cooled gas stream; and an insulated cold recovery system configured to receive the cooled gas stream from the heat exchanger, the insulated cold recovery system comprising: at least one cold recovery vessel configured to receive the cooled gas stream, the cold recovery vessel comprising a cold recovery material configured to cool the cooled gas stream, wherein the cooled gas stream is fed through the cold recovery vessel in a pipe immersed in the cold recovery material to produce a liquefied or low temperature gas; a first expansion valve configured to receive the cooled gas stream and reduce a pressure of the cooled gas stream to a storage pressure; and at least one storage tank configured to receive the liquefied or low temperature gas from the first expansion valve and store the liquefied or low temperature gas in a liquid or low temperature state, wherein when the liquefied or low temperature gas is released from the storage tank, the liquefied or low temperature gas vaporizes in the pipe and cools the cold recovery material.

In accordance with another embodiment, a system for liquefaction of natural gas, the system including: a compressor configured to receive a gas stream and produce a compressed gas stream; a heat exchanger configured to receive the compressed gas stream and produce a cooled gas stream; and an insulated cold recovery system configured to receive the cooled gas stream from the heat exchanger, the insulated cold recovery system comprising: a plurality of cold recovery vessels, each of the plurality of cold recovery vessels comprising a cold recovery material configured to cool the cooled gas stream, wherein the cooled gas stream is fed through the cold recovery vessel in a pipe immersed in the cold recovery material; a first expansion valve positioned and configured to receive the cooled gas stream from the plurality of cold recovery vessels; a final cold recovery vessel positioned and configured to receive the cooled gas stream from the first expansion valve and liquefy the gas stream into a liquid state; a second expansion valve positioned and configured to receive the cooled gas stream from the final cold recovery vessel; and at least one storage tank configured to receive the liquefied gas and store the liquefied gas in the liquid state, wherein the liquefied gas stream vaporizes through the second expansion valve and passes through the pipe and cools the cold recovery material of each of the plurality of cold recovery vessels.

In accordance with a further embodiment, a system for liquefaction of gases, the system including: a compressor configured to receive a gas stream and produce a compressed gas stream; a heat exchanger configured to receive the compressed gas stream and produce a cooled gas stream; and an insulated cold recovery system configured to receive the cooled gas stream from the heat exchanger, the insulated cold recovery system comprising: a plurality of cold recovery vessels, each of the plurality of cold recovery vessels comprising a cold recovery material configured to cool the cooled gas stream, wherein the cooled gas stream is fed through the cold recovery vessel in a pipe immersed in the cold recovery material to produce a liquefied gas; at least one by-pass valve configured to route the cooled gas stream through or around a selected cold recovery vessel; at least one turbine configured to expand and cool the cooled gas stream during the liquefaction of the gas stream, the at least one turbine positioned between the plurality of cold recovery vessels; an independent stationary liquefaction unit position between the plurality of cold recovery vessels and at least one storage tank, wherein the liquefaction unit is configured to liquefy the cooled gas stream into a liquefied gas stream; and at least one storage tank configured to receive the liquefied gas stream from the independent liquefaction unit and store the liquefied gas stream in a liquid state, and wherein the liquefied gas stream vaporizes through a pipe and cools the cold recovery material of the plurality of cold recovery vessels.

In accordance with a further embodiment, a system for liquefaction of gases, the system including: a compressor configured to receive a gas stream and produce a compressed gas stream; a heat exchanger configured to receive the compressed gas stream and produce a cooled gas stream; and an insulated cold recovery system configured to receive the cooled gas stream from the heat exchanger, the insulated cold recovery system comprising: a plurality of cold recovery vessels, each of the plurality of cold recovery vessels comprising a cold recovery material configured to cool the cooled gas stream, wherein the cooled gas stream is fed through the cold recovery vessel in a pipe immersed in the cold recovery material to produce a liquefied gas; at least one by-pass valve configured to route the cooled gas stream through or around a selected cold recovery vessel; at least one turbine configured to expand and cool the cooled gas stream during the consumption of the gas stream, the at least one turbine positioned between the plurality of cold recovery vessels; an independent stationary liquefaction unit position between the plurality of cold recovery vessels and at least one storage tank, wherein the liquefaction unit is configured to liquefy the cooled gas stream into a liquefied gas stream; and at least one storage tank configured to receive the liquefied gas stream from the independent liquefaction unit and store the liquefied gas stream in a liquid state, and wherein the liquefied gas stream vaporizes through a pipe and cools the cold recovery material of the cold recovery vessel before expanding in the at least one turbine and cooling the cold recovery material of the plurality of cold recovery vessels.

In accordance with another embodiment, a process for storing gases at low temperatures using a cold recovery system including: compressing a gas stream in a compressor to form a compressed gas; passing the compressed gas stream through a heat exchanger to form a cooled gas stream; cooling the cooled gas stream in an insulated cold recovery system, the insulated cold recovery system comprising: at least one cold recovery vessel configured to receive the cooled gas stream, the cold recovery vessel comprising a cold recovery material configured to liquefy the cooled gas stream, wherein the cooled gas stream is fed through the cold recovery vessel in a pipe immersed in the cold recovery material to produce a liquefied gas; at least one expansion valve, the at least one expansion valve configured to reduce a pressure of the cooled gas stream; and at least one storage tank configured to receive and store the liquefied gas; storing the liquefied gas in a liquid state in the at least one storage tank; and vaporizing the liquefied gas from the storage tank of the cold recovery system through the at least one cold recovery vessel, wherein the vaporization of the gas stream cools the cold recovery material.

In accordance with a further embodiment, an insulated cold recovery system used to recover the refrigeration existing when a gas is stored at low temperature including: at least one cold recovery vessel configured to receive a gas stream from a gas source, the cold recovery vessel comprising a cold recovery material configured to reduce the temperature of the gas stream, wherein the gas stream is fed through the cold recovery vessel in a pipe immersed in the cold recovery material to produce a liquefied or low temperature gas; an expansion valve configured to receive the gas stream and reduce a pressure of the gas stream to a storage pressure; and at least one storage tank configured to receive the liquefied or low temperature gas from the expansion valve and store the liquefied or low temperature gas in a liquid or low temperature state, wherein when the liquefied or low temperature gas is released from the insulated cold recovery system, the liquefied vaporizes or low temperature gas expands through the pipe and cools the cold recovery material.

In accordance with another embodiment, a system for liquefaction of natural gas, the system including: a compressor configured to receive a gas stream and produce a compressed gas stream; a heat exchanger configured to receive the compressed gas stream and produce a cooled gas stream; and an insulated cold recovery system configured to receive the cooled gas stream from the heat exchanger, the insulated cold recovery system including: a plurality of cold recovery vessels, each of the plurality of cold recovery vessels comprising a cold recovery material configured to cool the cooled gas stream, wherein the cooled gas stream is fed through the cold recovery vessel in a pipe immersed in the cold recovery material to produce a liquefied gas; at least one contamination removal apparatus configured to remove contaminants from the cooled gas stream, wherein the at least one contaminant removal apparatus is positioned between two of the plurality of cold recovery vessels; a first expansion valve positioned and configured to receive the cooled gas stream from the plurality of cold recovery vessels; a final cold recovery vessel positioned and configured to receive the cooled gas stream from the first expansion valve and liquefy the cooled gas stream into a liquid state; a second expansion valve positioned and configured to receive the cooled gas stream from the final cold recovery vessel; and at least one storage tank configured to receive the liquefied gas and store the gas in the liquid state, wherein the liquefied gas vaporizes through the second expansion valve and passes through the pipe and cools the cold recovery material of each of the plurality of cold recovery vessels.

DETAILED DESCRIPTION

Figure 1:
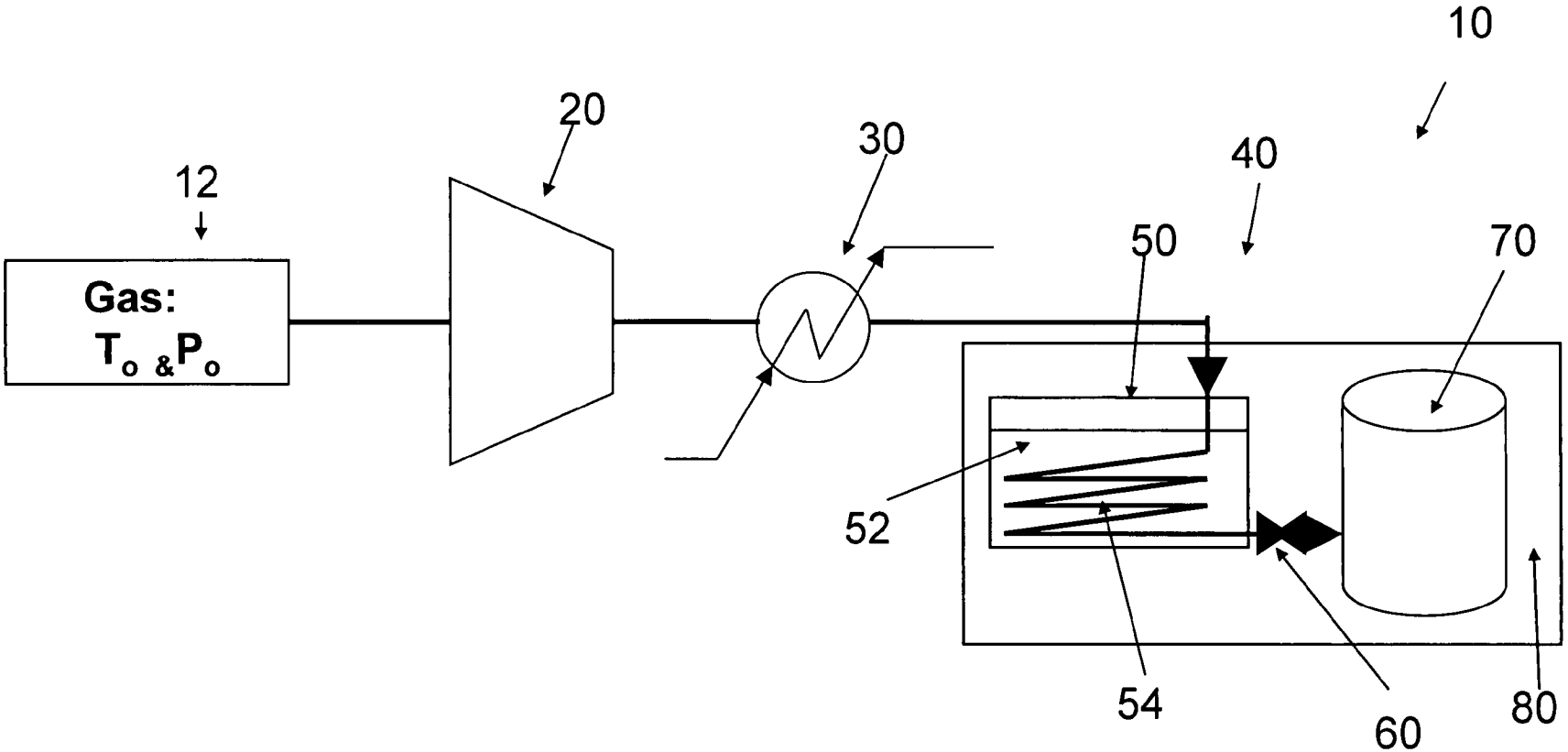
FIG. 1 shows a general schematic flow diagram of a process configured to store gas at low temperature using a cold recovery system.

FIG. 1 shows a general system 10 for storing gases at low temperature using a cold recovery system. The system 10 includes a compressor 20, a heat exchanger 30, and an insulated cold recovery system 40. The cold recovery system (CRS) 40 includes at least one cold recovery vessel (CRV) 50, an expansion valve 60 and a storage tank 70. As shown in FIG. 1, a gas stream 12 (at a temperature ($T_o$) and pressure ($P_o$)) enters the system 10 and is compressed in a compressor 20. The compressor 20 compresses the gas stream 12 from a first pressure of about 1 bar to about 10 bar to a second pressure of about 15 bar to about 70 bar. The increased pressure causes the gas stream to exit the compressor 20 at a temperature greater than the temperature that the gas stream entered the compressor 20.

A heat exchanger 30 cools the gas stream to a temperature about equal to the temperature in which the gas stream entered the compressor. The heat exchange 30 is preferably a water-cooled heat exchanger. However, it can be appreciated that any suitable heat exchanger can be used.

The gas stream then enters the insulated cold recovery system 40, which includes at least one cold recovery vessel 50, at least one expansion valve 60 and a storage tank 70. The at least one cold recovery vessel 50 includes a cold recovery material 52, and a pipe 54 or suitable device for heat transfer configured to receive the gas and transport the gas through the cold recovery vessel 50. The pipe 54 is preferably a coiled pipe, however the pipe 54 can be a tube, a conduit, a duct or an equivalent device adapted to convey the gas stream through the cold recovery material 52 while cooling the gas stream.

The cold recovery vessel 50, pipe 54, expansion valve 60 and the storage tank 70 can be manufactured from stainless steel, copper, aluminum, iron, carbon steel or any other material with a working design conditions according to the gas to be stored, the temperature and pressure of the system. It can be appreciated that the gas stream can enter the cold recovery system 40 without compression and heat exchange in the compressor 20 and heat exchanger 30, if the gas stream is at the required initial temperature ($T_i$) and the required initial pressure ($P_i$).

The cold recovery material 52 cools the gas stream from a first temperature to a second temperature. As a result of the cooling of the gas, the temperature of the cold recovery material 52 also undergoes a temperature change. The cold recovery material 52 is selected based on the operating temperature of the cold recovery vessel 50 in both liquefaction and vaporization of the gas stream, and the heat transport properties (melting point, its latent heat of fusion, heat specific in states liquid or solid, its thermal conductivity, etc) of the cold recovery material 52. The cold recovery material 52 can be a pure or a mixture of materials as acetic acid, water, ethylenglicol, n-decane, n-octane, acetone, 1methyl 4 ethyl benzene, n-pentane, 2 methyl pentane, propylene, argon, nitrogen, ethanol, or any other suitable material for cooling of a gas such as oxygen, nitrogen, ethane, methane, hydrogen, helium or any other pure gas or mixture of them. It can be appreciated that an anti-freezing substance can be used to adjust the melting point of the cold recovery material 52. The cold recovery material 52 can also include additives to adjust or change the physical properties of the cold recovery material 52.

The expansion valve 60 is positioned between a final cold recovery vessel 50 and a storage tank 70. The expansion valve 60 is adapted to receive the cooled gas stream and reduce the pressure of the gas stream to a pressure for storage of the gas stream in the storage tank 70.

Once the gas has been cooled to a desired temperature, the gas is stored in the storage tank 70. The storage tank 70 and the cold recovery vessel 50 are contained within the insulated cold recovery system 40.

An insulation material 80 provides insulation for each of the cold recovery vessels 50 located within the cold recovery system 40. The insulation material 80 is preferably a microporous insulation such as a finely ground, powdery substance comprised of a blend of ceramic powders and fibers, cotton, fiberglass or suitable material with the required thermal conductivity, or a vacuum, low temperature insulation method, a multi-layer insulation of suitable material or combination of insulating materials and methods.

Although the gases described in the application include methane and hydrogen, the apparatus and methods described herein can be used with any gas, which can be liquefied or stored at low temperature.

Figure 2:
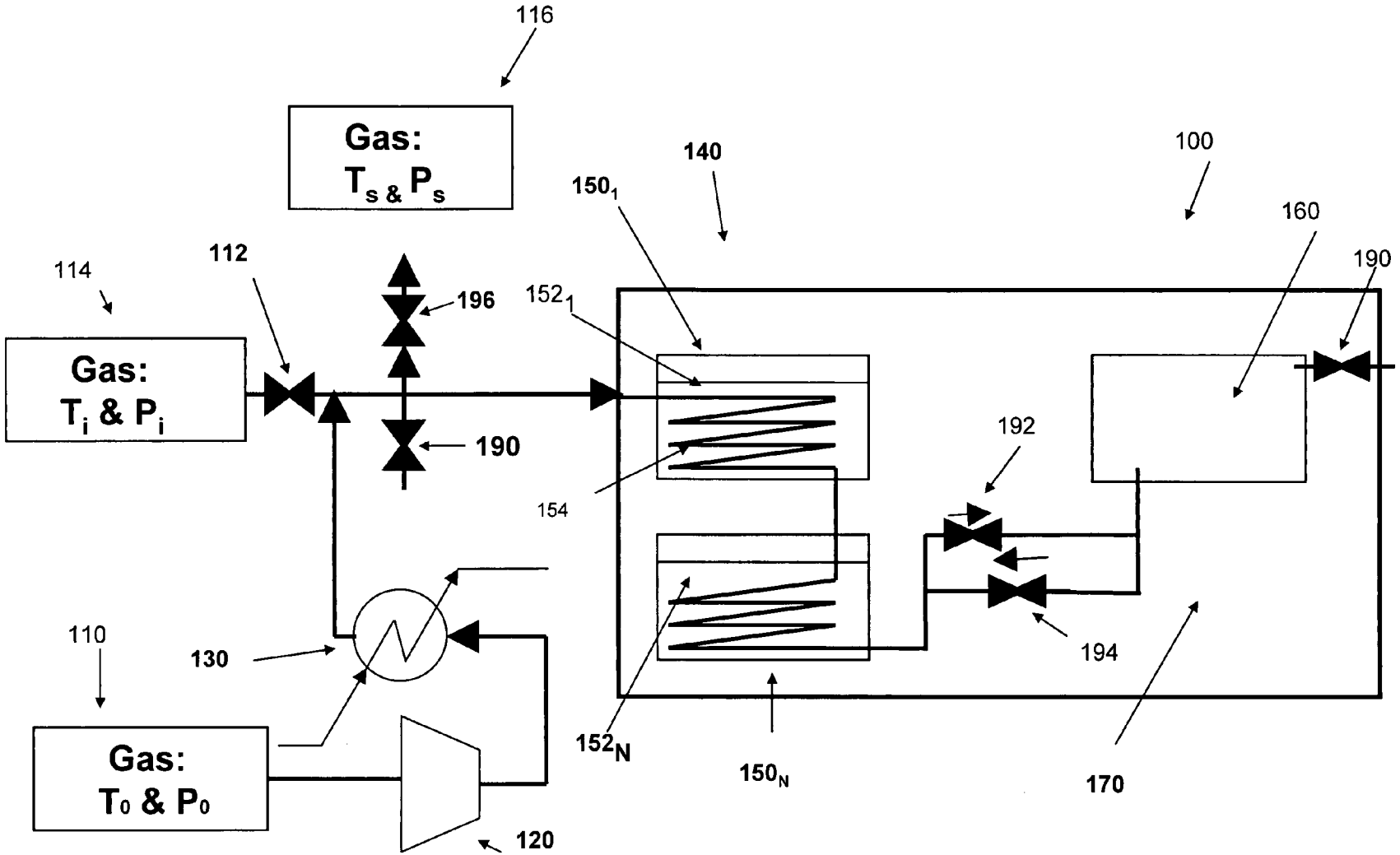
FIG. 2 shows a schematic flow diagram of a process when a gas is stored at low temperature in gas form according to one embodiment.

FIG. 2 shows a system for storing gases at low temperature 100 having one or more cold recovery vessels 150 ($CRV_1$ to $CRV_N$). Each of the cold recovery vessels 150 preferably includes a cold recovery material 152 ($CRM_1$ to $CRM_N$), a pipe 154 or suitable device for heat transfer, which further reduces the temperature of the gas stream. It can be appreciated that the cold recovery material 152 can be a liquid, a solid, a gas or a mixture thereof. The cold recovery material 152 in each of the cold recovery vessels 150 preferably has different physical properties.

As shown in FIG. 2, the gas stream is taken at an initial temperature ($T_o$) and pressure ($P_o$) from a first gas source 110. The gas stream is then compressed using a compressor 120, which increases the pressure to reach the initial required pressure and then it is cooled in a heat exchanger 130 where an initial temperature is reached. If the gas stream is at the required initial conditions ($T_i$ and $P_i$), then the gas stream can be taken from a second gas source 114 using a valve 112 and fed directly to the cold recovery system 140. The initial required pressure ($P_i$) is determined depending on the estimated consumption rate of the gas to be stored.

The cold recovery system 140 includes a plurality of cold recovery vessels $\mathbf{150}_N$, each of the plurality of cold recovery vessels $\mathbf{150}_N$ having a cold recovery material 152 configured to cool the cooled gas stream. The gas stream is fed through the cold recovery vessel 150 through a pipe 154 immersed in the cold recovery material 152 to produce a liquefied gas. The pipe 154 is preferably a coiled pipe, tube, conduit, duct or other suitable device adapted to convey the gas stream through the cold recovery vessel 150 and cold recovery material 152.

An insulation material 170 provides insulation for the plurality of cold recovery vessels 150 located within the cold recovery system 140. The insulation material 170 is preferably a micro-porous insulation such as a finely ground, powdery substance comprised of a blend of ceramic powders and fibers, a multi-layer insulation of suitable material or any other suitable material. Alternatively, the insulation material can include a vacuum.

Once the gas stream is fed to the cold recovery system 140, the gas stream passes through the pipe 154 immersed in the cold recovery material 152 of the cold recovery vessels. The cold recovery material 152 is pre-cooled until reaching a first cold recovery material temperature. The first cold recovery material 152 temperature is preferably lower than the initial temperature of the gas stream by using a plurality of refrigeration valves 190 to add a refrigerant material, such as liquid nitrogen to the pipe 154 immersed in the cold recovery material 152. It is desirable that the temperature of the first cold recovery vessel $\mathbf{150}_1$ ($CRV_1$) is higher than the second cold recovery vessel $\mathbf{150}_2$ ($CRV_2$), and so on such that the temperature of the last cold recovery vessel $\mathbf{150}_N$ ($CRV_N$) has the lowest cold recovery material temperature 152. Accordingly, when the gas stream exits each cold recovery vessel 150, the temperature of the gas stream is lower to a desired temperature for storage in a storage tank 160.

After the last cold recovery vessel $\mathbf{150}_N$ ($CRV_N$), the gas stream passes through a first expansion valve 192, where the pressure of the gas stream is reduced to a desired storage pressure and temperature. The reduction in the temperature of the gas stream is a function of the difference between the initial pressure and storage pressure of the gas stream. Thus, the first expansion valve 192 is designed to open when the pressure of the gas stream in the pipe 154 almost reaches the initial pressure.

A second expansion valve 194 is designed to open when the pressure of the pipe 154 is a little lower than the service pressure. Accordingly, since the system 100 works when the initial pressure is higher than the storage pressure, the second expansion valve 194 keeps closed during the storage process.

During the liquefaction of cooling process, the cold recovery material 152 in each of the cold recovery vessels 150 is gradually heated. Accordingly, when the stored liquefied gas is going to be consumed, a service valve is opened 196, and the pressure of the pipe 154 drops causing the first expansion valve 192 to close. When the pressure of the pipe 154 reaches the service pressure, the second expansion valve 194 opens and the liquefied gas stored in the storage tank 160 starts leaving the cold recovery system 140. When the gas stream passes through the second expansion valve 194, an additional expansion takes places and the temperature of the gas stream is reduced causing a temperature difference between the cold recovery materials 152 and the gas stream.

As the liquefied gas of the tank 160 is consumed and vaporized, the cold recovery material 152 is cooled to the final temperature of the cold recovery material for each of the cold recovery vessels 150. The pipe 154 of the system can be designed such that the final temperature of the cold recovery material 152 is similar to the initial temperature of the cold recovery material after opening of the service valve 196 and releasing the liquefied or low temperature gas stream.

The gas stream exits the cold recovery system 140 at a service temperature ($T_s$), which is similar to that of the initial temperature of the gas stream, and is then sent to the consumption line through the service valve 196. The gas stream exits through the service valve 196 at a service temperature ($T_s$) and service pressure ($P_s$) to a consumption port 116.

Figure 3:
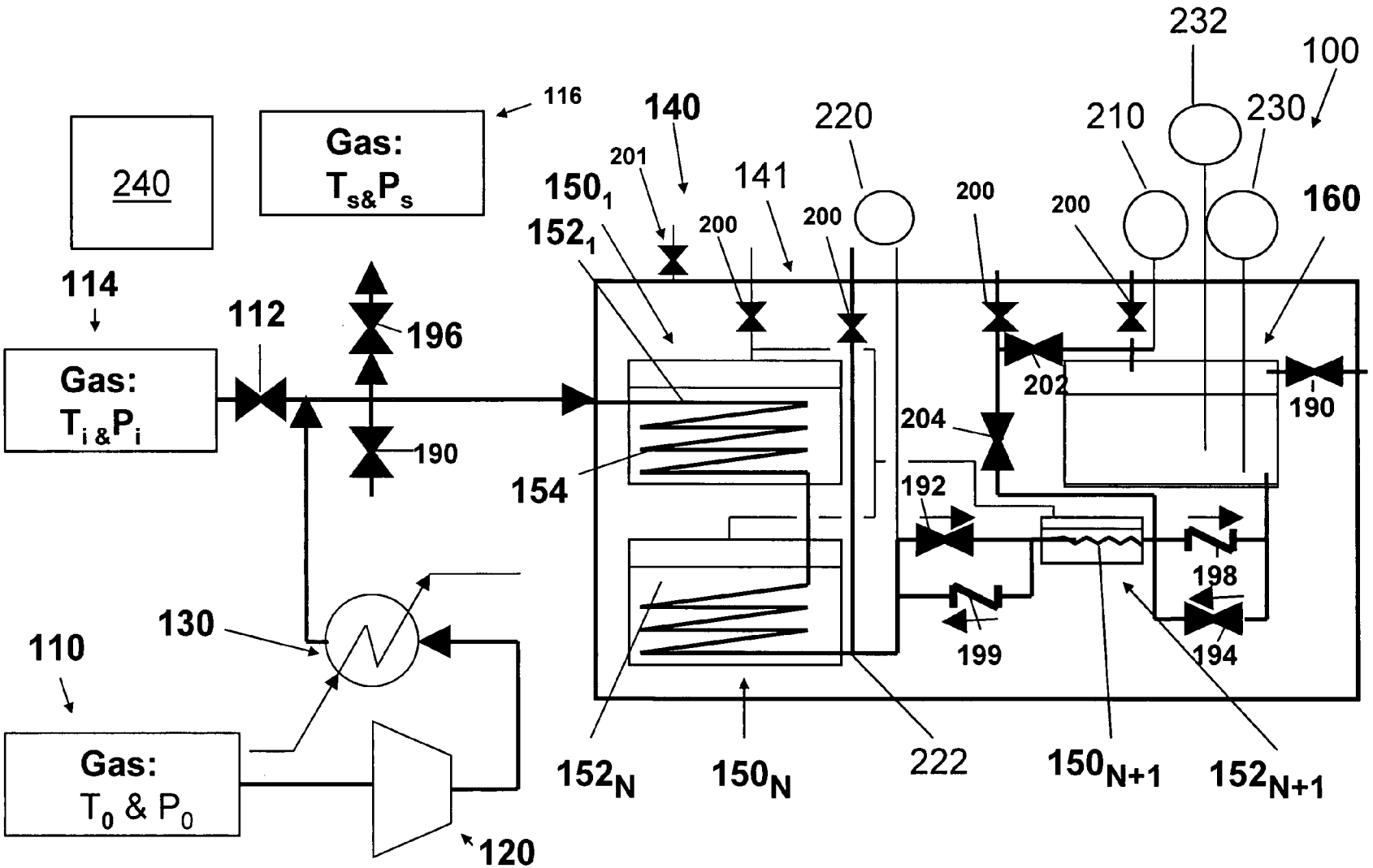
FIG. 3 shows a schematic flow diagram of a process when a gas is stored at low temperature in liquid form according to an alternative embodiment.

As observed in FIG. 3, an alternative embodiment for a system and method of storing gases at low temperature as liquid is shown. In FIG. 3, the system is similar to the embodiment as shown in FIG. 2, however, the desired temperature of the gas stream is selected by making a portion of the gas stream in a liquid state as the gas stream passes through the first expansion valve 192. The first expansion valve 192 opens and expansion of the gas allows the gas stream to reach an equilibrium temperature at the storage pressure. Because only a part of the gas remains in liquid form after the first expansion valve 192, a final cold recovery vessel $\mathbf{150}_{N+1}$ ($CRV_{N+1}$) is placed to condensate or liquefy the remainder of the gas stream.

In addition, since the system 100 uses an expansion valve 192 before the gas stream passes through the final cold recovery vessel $\mathbf{150}_{N+1}$ ($CRV_{N+1}$) in both the storage and the consumption process it is necessary to include at least two check valves 198, 199 configured to control the flow of the gas stream. When the liquefied or low temperature gas is going to be consumed, the service valve 196 opens like in the other embodiments, which causes the pressure within the pipe 154 to drop. The change in the pressure within the pipe 154 closes the first expansion valve 192. As the pressure within the pipe 154 continues to drop until reaching the service pressure, wherein the second expansion valve 194 opens and the liquefied gas starts leaving the storage tank 160. The liquefied or low temperature gas passes through the second expansion valve 194 where the pressure of the gas stream goes from the storage pressure to the service pressure.

The liquefied gas stream is saturated as it passes through the second expansion valve 194, such that the reduction in pressure of the liquefied gas stream causes the liquid to vaporize at a lower temperature than the storage temperature of the liquefied gas. This temperature reduction causes the cold recovery material 152 to undergoing cooling as the gas stream vaporizes through the plurality of cold recovery vessels 150.

It is also desirable to incorporated technical considerations into the system 100 as shown in FIG. 3. For example, in any system where there is an increase in the temperature of a gas stream, whose volume is fixed, the gas stream can cause an increase in pressure that might result in a release of energy. This same effect appears with liquefied gases, making it desirable to incorporate into the system a plurality of safety valves 200. In addition, since a leak in the pipe 154 can increase the cold recovery system pressure, it is often desirable to have an external safety valve 201 on an external surface 141 of the system 140 to protect the cold recovery vessels 150. For example, as shown in FIG. 3, the system 100 includes four safety valves 200 within the insulated cold recovery system 140 and a fifth safety valve 201 on the external surface 141 of the system 140. The safety valves 200 are preferably connect to each of the plurality of cold recovery vessels 140 and the storage tank 160.

The pressure of the storage tank 160 can be controlled with an automatic pressure-reducing valve 202 that opens when the pressure of the storage tank 160 reaches a predetermined pressure. In addition to the automatic pressure-reducing valve 202, it is desirable to include an additional expansion valve 204 configured to assist with obtaining the desired service pressure of the gas stream.

In addition, it is desirable for the cold recovery system 140 to be cooled before starting the condensation of the gas stream to a liquid state. In one embodiment, cryogenic liquids such as helium, nitrogen, argon, or refrigerants such as ammonia, Freon, carbon dioxide, etc., can be added to the system 140 through a plurality of refrigeration valves 190. Alternatively, any suitable liquid or material can be used to cool the cold recovery system 140 before beginning the condensation of the gas stream.

In another embodiment, depending on the vaporization of the gas stream, the cold recovery system 140 can establish the optimum operation considerations for the system 100 and the cooling of the cold recovery system 140 is not required.

The system 100 can include one or more pressure meters 210 in the top of the tank 160 as well as a temperature-measuring instrument 220 at a cold recovery system exit 222. The one or more pressure meters 210 provide an added safety feature by reducing the over pressure risk and controlling the operation of the system 100. It can also be desirable that the one or more pressure meters 210 have the ability to warn the user before any of the plurality of safety valves 200 on the system 100 open.

A second pressure meter 230 can be installed in a lower portion of the storage tank 160 for the purpose of determining the amount of liquefied gas in the tank 160. The second pressure meter 230 generates a signal that calculates the pressure differential within the tank 160. The pressure differential is then displayed by providing a visual reading of the amount of liquefied gas in the tank 160.

In addition, a temperature meter 232 can be installed in the tank 160. The temperature meter 232 provides a reading of the temperature of the liquefied gas. For example, if the desired temperature is not reached, the temperature meter 232 provides a warning to the user that the desired temperature has not been obtained.

A microprocessor 240 can be used to receive the information from the one or more pressure meters 210, 230, and the temperature meters 220, 232 for safety control and monitoring of the system conditions. For example, the microprocessor 240 can calculate when additional cooling of the tank 160 is necessary or to adjust the initial required pressure ($P_i$).

EXAMPLE 1

In example 1, a process to store natural gas as liquid, wherein the gas is received from the local distribution lines or from a high-pressure transportation lines is shown. This example considers the natural gas to have 100% of methane. However, it can be appreciated that the system is not limited to process for liquefaction of methane gas and that the system and its use could work with a wide variety of gases.

Figure 4:
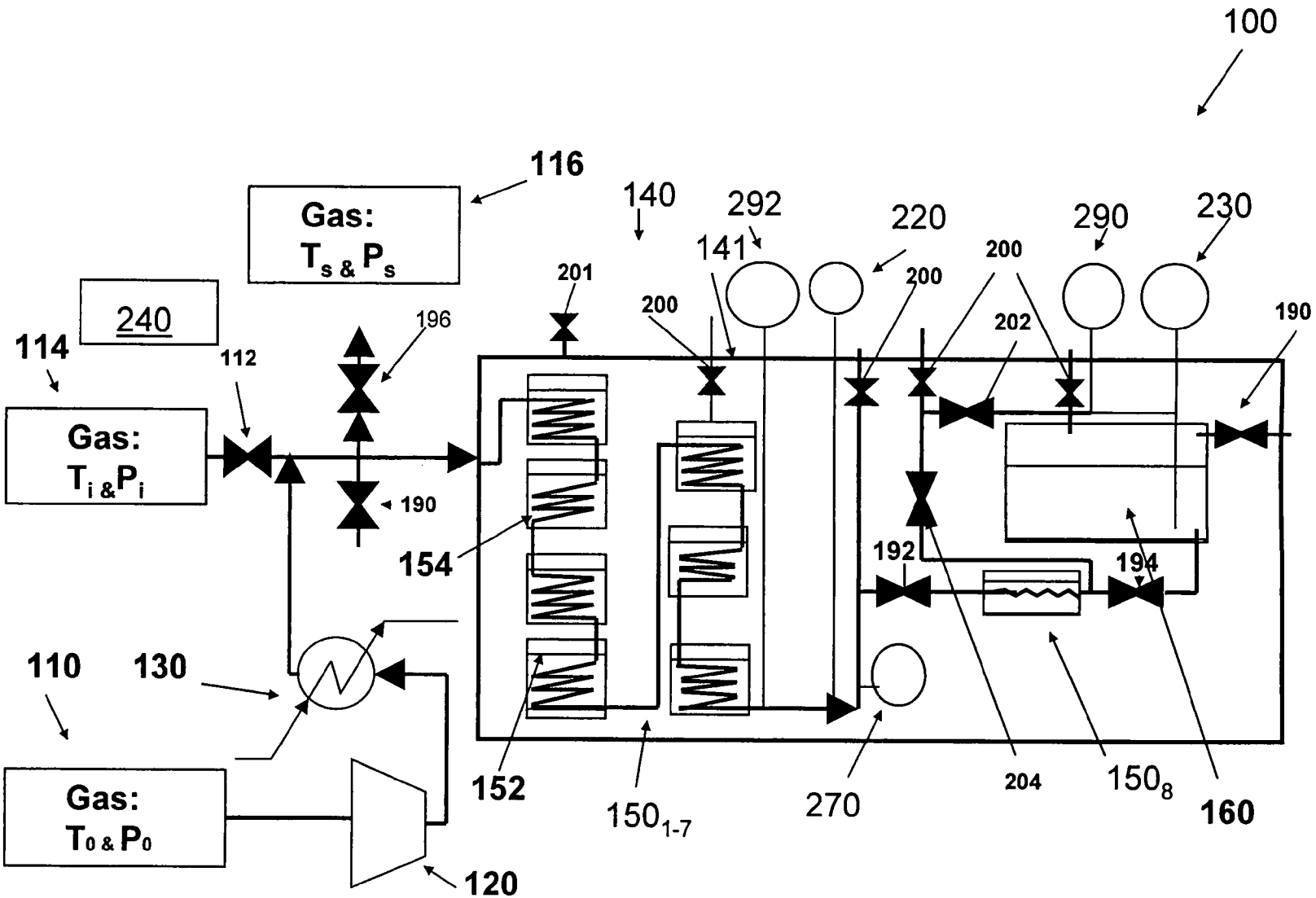
FIG. 4 shows a schematic flow diagram of a process to store gas in liquid form including a low-pressure expansion valve according to the embodiment of FIG. 3.

As shown in FIG. 4, the cold recovery system includes eight cold recovery vessels $\mathbf{150}_{1\text{-}8}$($CRV_{1\text{-}8}$). The compressor 120 receives the gas stream from the local distribution line 110 with a pressure of about 5 bar and about 27° C. and it increases the pressure to about 60 bar. The gas steam is cooled in the heat exchanger 130 to about 27° C. The compressed gas stream is transferred to the cold recovery system 140 that uses the following cold recovery materials (CRM):

$CRM_1$: Solid Acetic Acid at 0° C.
$CRM_2$: Water Ice at −13° C.
$CRM_3$: Solid Ethylenglicol at −32° C.
$CRM_4$: Solid n-decane at −57° C.
$CRM_5$: Solid n-octane at −88° C.
$CRM_6$: Solid Acetone at −138° C.
$CRM_7$: Solid ethanol at −146° C.
$CRM_8$: Solid ethanol at −146° C.

In the first cold recovery vessel 150 ($CRV_1$), the methane gas stream uses the refrigeration in the acetic acid reducing the gas stream temperature to about 18° C., after this vessel the ice in the second cold recovery vessel 150 ($CRV_2$) reduces the methane gas stream temperature to 5° C. The methane passes through a third cold recovery vessel 150 ($CRV_3$) where the temperature reaches −9° C. while at the end of the forth-cold recovery vessel 150 ($CRV_4$), the temperature reduces to −27° C.

The methane is cooled in a fifth cold recovery vessel 150 ($CRV_5$) and a sixth cold recovery vessel 150 ($CRV_6$) to −46° C. and −73° C. Before the first expansion valve 192, the gas passes through a seventh cold recovery vessel 150 ($CRV_7$) where its temperature is −93° C. At this point in the process, the pressure of the methane gas stream is almost 60 bars, such that the methane has been liquefied.

The methane at this condition then passes through the first expansion valve 192 where the methane gas stream is expanded to a pressure of 16 bars and a reduced temperature of about −113° C. At this point almost 27% of the methane has been vaporized, such that an eighth cold recovery vessel 150 ($CRV_8$) condensates the remaining non liquefied fraction of the gas before the methane can be stored in the tank 160 in a liquid state.

At the end of the storage process the temperature of the cold recovery vessels 150 (CRV) have been increased to:

$CRV_1$: 17° C.
$CRV_2$: 12° C.
$CRV_3$: −1° C.

$CRV_4$: −14° C.
$CRV_5$: −32° C.
$CRV_6$: −51° C.
$CRV_7$: −78° C.
$CRV_8$: −114° C.

During the consumption step (or vaporization) of the liquefied gas, heat losses consume almost 5% of the methane gas stream as the gas is vaporized. When the service valve 196 opens, the pressure within the pipe 154 reduces and the second expansion valve 194 opens to keep the pressure according with a service pressure of 2.7 bars. After the second expansion valve 194, part of the methane has been vaporized while its temperature reduces to −148° C. to pass through the eighth cold recovery vessel 150 ($CRV_8$) and because this vessel is able to vaporize only a part of the methane, the temperature keeps at −148° C.

At the end of the seventh cold recovery vessel 150 ($CRV_7$) all the methane is gas and its temperature reaches −144° C. At the end of the sixth cold recovery vessel 150 ($CRV_6$) and the fifth cold recovery vessel 150 ($CRV_5$) the methane is heated to −93° C. and −61° C. When the methane passes through the fourth cold recovery vessel 150 ($CRV_4$) its temperature increases at −36° C. while in the third cold recovery vessel 150 ($CRV_3$) is heated to −19° C.

In the second cold recovery vessel 150 ($CRV_2$) the methane becomes the water in ice and its temperature reaches −2.5° C. and at the end of the first cold recovery vessel 150 ($CRV_1$) its temperature reaches 9° C.

According with the heat balance in each of the cold recovery vessel 150, the temperature of the cold recovery materials 152 after all the gas stored in the storage tank 160 has been consumed is almost the same as the initial temperature so the system is ready to cool the gas stream for the next refilling of the storage tank 160.

EXAMPLE 2

Figure 5:
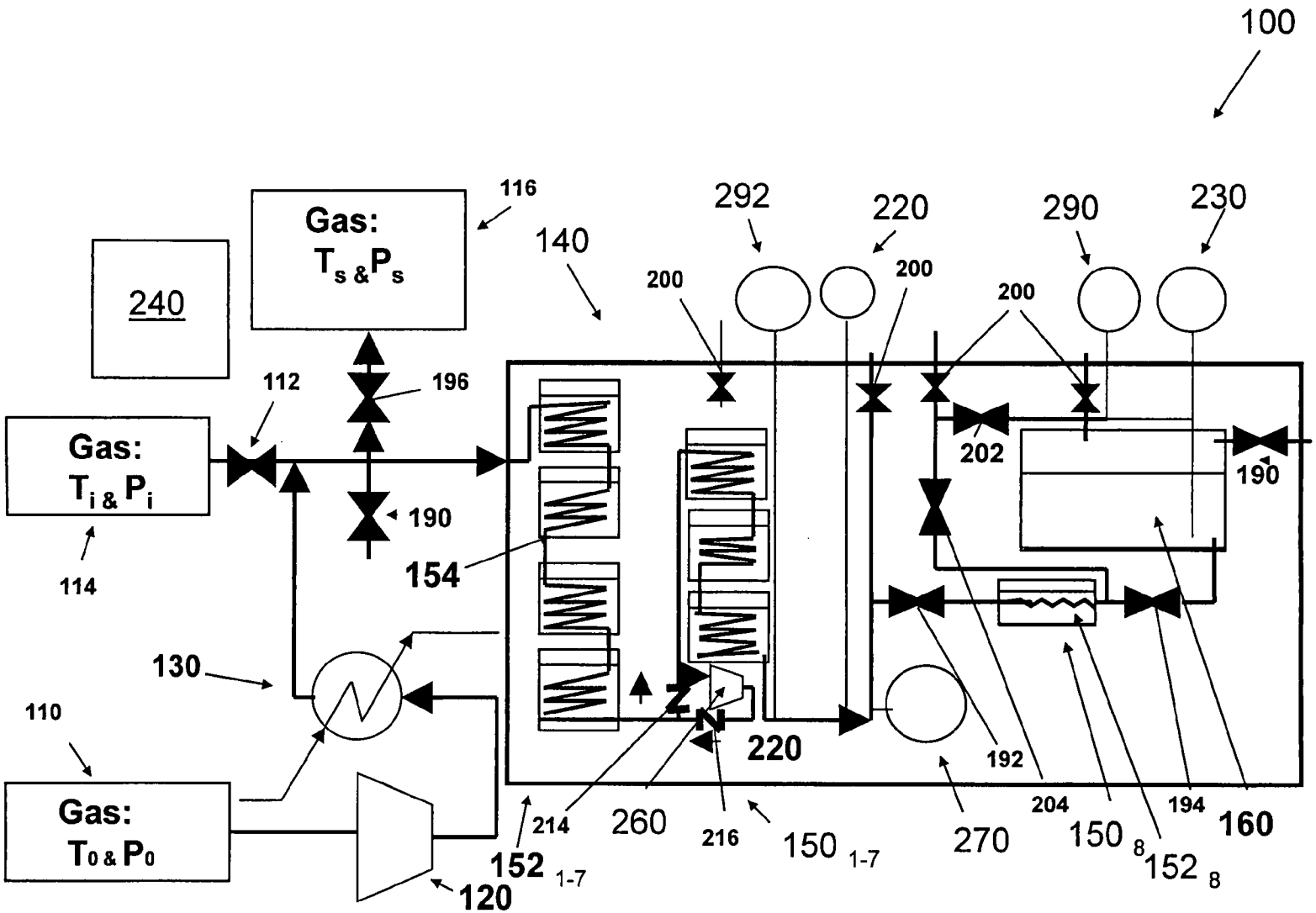
FIG. 5 shows a schematic flow diagram of a process to store gas in liquid form according to another embodiment.

Example 2 describes a process to store natural gas (i.e. methane gas) as a liquid using a low-pressure turbine and taking the gas from the local distribution lines or from the high-pressure transportation lines. As shown in FIG. 5, in this example, the process includes: a least one compressor 120, at least one heat exchanger 130, a cold recovery system 140 (CRS), at least one turbine 260 and a storage tank 160.

The purified natural gas stream is received from a gas source 110 at a temperature (To) and pressure (Po) and is compressed and cooled to 27° C. and 40 Bar by the at least one compressor 120 and the at least one heat exchanger 130, respectively. It can be appreciated that if the gas stream is at the desired initial temperature (Ti) and pressure (Pi), the gas stream can be received from a secondary gas source 114.

In this example, the cold recovery system 140 (CRS) has eight cold recovery vessel 150 (CRV) with the following cold recovery materials 152 (CRM):

$CRM_1$: Solid water at a −23° C.
$CRM_2$: Solid Ethylenglicol at −32° C.
$CRM_3$: Solid n-decane at a −73° C.
$CRM_4$: Solid Amilic alcohol at −130° C.
$CRM_5$: Solid Amilic alcohol at −93° C.
$CRM_6$: Solid Acetone at −118° C.
$CRM_7$: Solid ethylic Ether at −118° C.
$CRM_8$: Solid ethylic ether at −118° C.

In the first cold recovery vessel 150 ($CRV_1$) the methane reduces its temperature to 14.5° C., and after the second cold recovery vessel 150 ($CRV_2$) the temperature is 10° C. The methane passes through the third cold recovery vessel 150 ($CRV_3$) where the temperature reaches −24° C. while at the end of the fourth cold recovery vessel 150 ($CRV_4$), the temperature reduces to −65° C.

Before entering the fifth cold recovery vessel 150 ($CRV_5$) the gas passes through a by-pass check valve 214. The methane gas stream is then cooled in the fifth and sixth cold recovery vessels 150 ($CRV_5$ and $CRV_6$) to −71° C. and −87° C., respectively. Before a first expansion valve 192, the gas passes through the seventh cold recovery vessel 150 ($CRV_7$) and its temperature is −93° C. After passing through the seventh cold recovery vessel 150 ($CRV_7$) the methane gas having a pressure of almost 40 bars, has been liquefied. The methane gas stream at these conditions passes through the first expansion valve 192 where it is expanded to 16 bars and the temperature reduces to about −113° C.

At this point almost 27% of the methane has been vaporized, and the gas stream passes through an eighth (and final) cold recovery vessel 150 ($CRV_8$), which condensates the remaining gas into a liquid for storage in the tank 160.

At the end of the storage process the temperature of the cold recovery vessels 150 have been increased to:

$CRV_1$: 12° C.
$CRV_2$: 10° C.
$CRV_3$: 5° C.
$CRV_4$: −29° C.
$CRV_5$: −70° C.
$CRV_6$: −76° C.
$CRV_7$: −93° C.
$CRV_8$: −116° C.

During the consumption step, heat losses consume almost 5% of the methane as the gas is vaporized. To control the pressure of the tank 170, a first release valve 202 and a second release valve 204 are placed to send the gas from the tank to the eighth cold recovery vessel 150 ($CRV_8$). The first release valve 202 is adjusted to avoid that the pressure of the tank 160 be higher than the maximum allowable working pressure of the vessel and the second release valve 204 produce the expansion from the storage pressure (Pa) to the operating pressure of the turbine 260 (10 bars). When the service valve 196 opens, the pressure of the pipe 154 reduces and the second expansion valve 194 opens to keep the pressure at 10 bars.

After the second expansion valve 194, part of the methane has been vaporized while its temperature reduces to −123° C. to pass through the eighth cold recovery vessel 150 ($CRV_8$) and because this vessel is able to vaporize only a part of the methane, the temperature keeps at −123° C. In the same way, the temperature of the methane and the end of the seventh cold recovery vessel 150 ($CRV_7$) remain in −123° C. At the end of the sixth cold recovery vessel 150 ($CRV_6$) all the methane has been vaporized and the temperature reaches −98° C. When the methane passes through the fifth cold recovery vessel 150 ($CRV_5$) is heated to −89° C.

At this point, because the check valve 214 is closed as the gas stream enters the turbine 260 where the pressure of the gas stream is reduced to about 2.7 Bars and a temperature of about −136° C. The gas stream then passes thru the check valve 216 in order to enter the fourth cold recovery vessel 150 ($CRV_4$). When the methane gas stream passes through the fourth cold recovery vessel 150 ($CRV_4$) its temperature increases to −78° C. while in the third cold recovery vessel 150 ($CRV_3$) is heated to −36° C. In the second cold recovery vessel 150 ($CRV_2$) the temperature of the methane reaches −31° C. and at the end of the first cold recovery vessel 150 ($CRV_1$) its temperature reaches −17.5° C. The refrigeration produced by the turbine 260 allows the gas stream to exit the system 100 at −17.5° C. without affecting the next storage process.

As shown in FIGS. 4 and 5, the system 100 can include at least two pressure transmitters 290, 292 and a flow direction transmitter 270. The at least two pressure transmitters 290, 292, and the flow direction transmitters 270 send signals to the microprocessor 240 to control the expansion valves 192, 194. If the system 100 includes the at least two pressure transmitters 290, 292 and the flow direction transmitters 270, it is often not necessary to uses the checks valves 198, 199 as shown in the FIG. 3.

The flow direction transmitter 270 sends a signal to the microprocessor 240 to indicate if the system is in the storage process or in the consumption step. When the system is in the consumption step, the microprocessor 240 opens the first expansion valve 192, while the second pressure transmitter 292 allows the microprocessor 240 to control the second expansion valve 194 to keep the pressure at about 10 bars.

When the system 100 is in the storage stage, the microprocessor 240 opens the second expansion valve 194 and controls the pressure in the pipe 154 with the first expansion valve 192. The microprocessor 240 controls the pressure of the tank 160 using the signal of the first pressure transmitter 290 and opens the expansion valve 202.

EXAMPLE 3

Figure 6:
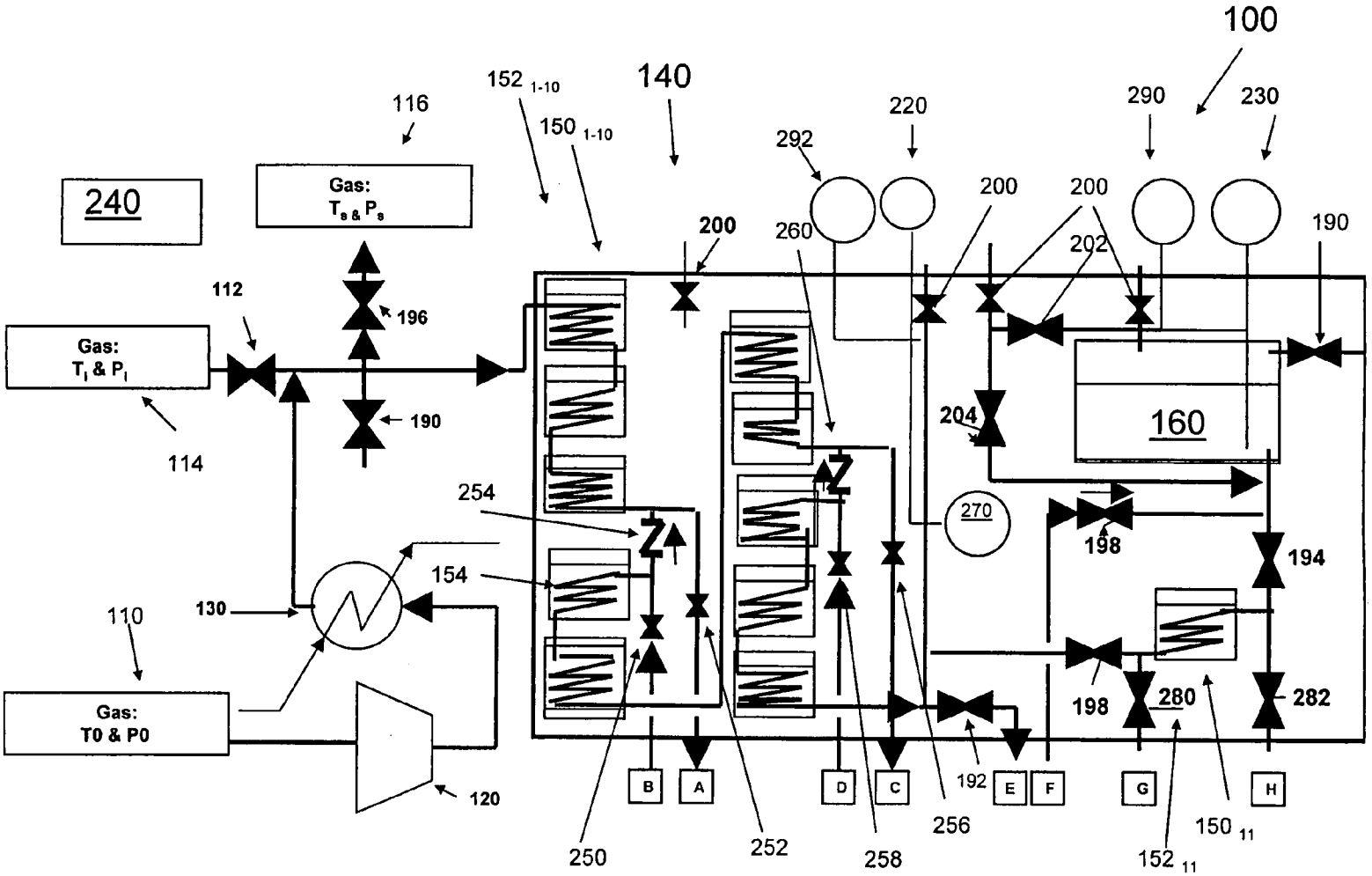
FIG. 6 shows a schematic flow diagram of a process to store hydrogen gas in liquid form according to an alternative embodiment.

Example 3 is a process to storage hydrogen using a cold recovery vessel and at least one high-pressure turbine, and taking the gas from the local distribution lines or from the high-pressure transportation lines. As observed in FIG. 6, the process 100 includes at least one compressor 120, at least one heat exchanger 130, and a cold recovery system 140 (CRS) including a plurality of cold recovery vessels 150, a plurality of by-pass valves 250, 252, 256, 258, a plurality of check valves 254, 260, and at least one storage tank 160. The system 100 also includes at least one independent stationary liquefaction unit 300 (FIG.7).

Figure 7:
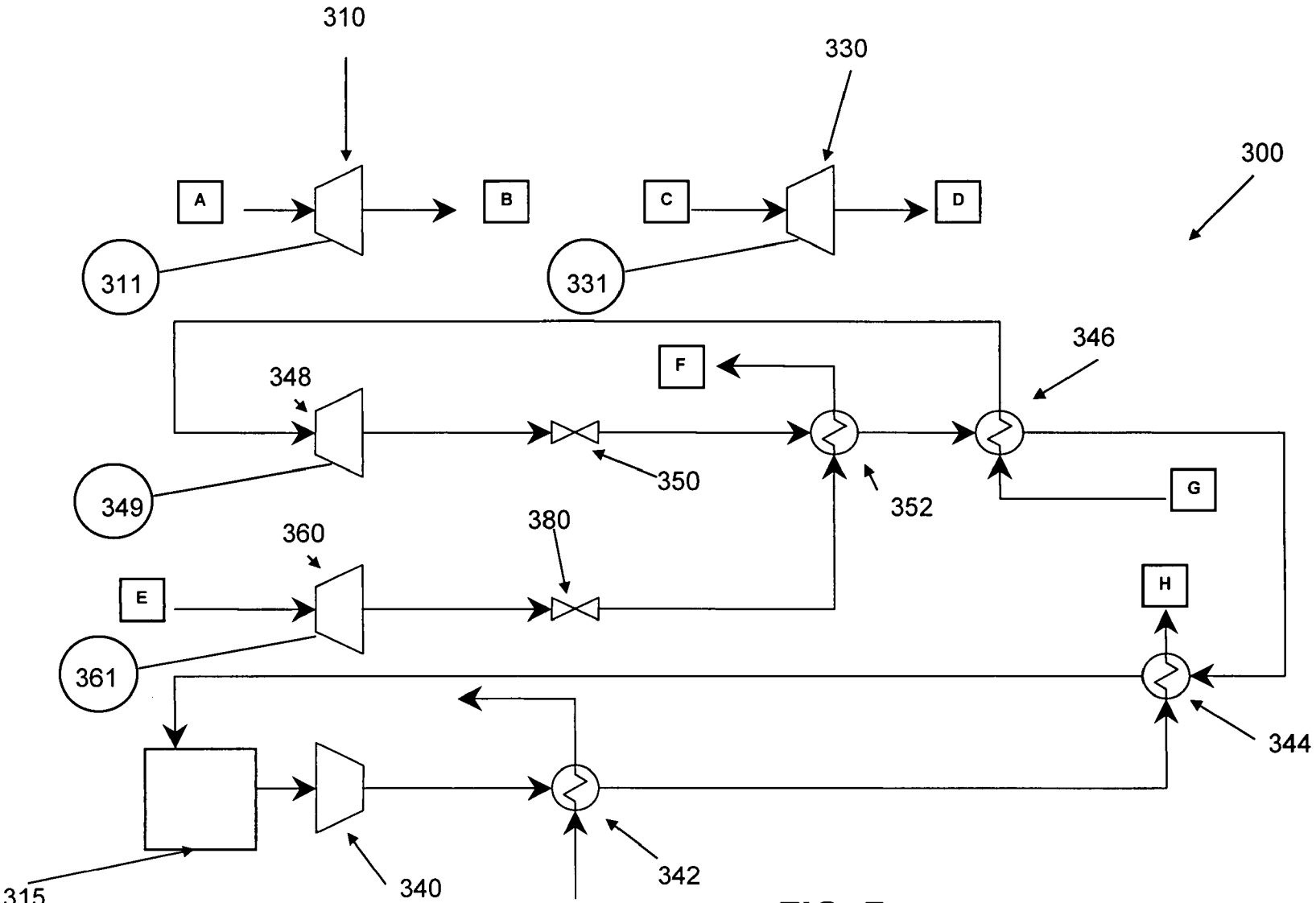
FIG. 7 shows a schematic flow diagram of the stationary liquefaction unit to be used in the alternative embodiment of FIG. 6.

FIG. 7 shows the independent stationary liquefaction unit 300, which includes at least one recycle gas tank 315, at least one recycle gas compressor 340, at least three heat exchangers 342, 344, 346, at least one recycle gas turbine 348, at least one recycle gas expansion valve 350, at least three stream gas turbines 310, 330, 360, at least one stream gas expansion valve 380, and at least one stream gas condenser 352. The at least one independent stationary liquefaction unit 300 is configured to assist with the liquefaction of the hydrogen gas stream and includes a separate recycle gas stream.

A first liquefaction unit valve 280 and a second liquefaction unit valve 282 separate the liquefaction unit 300 from the remainder of the cold recovery system 140. It can be appreciated that the liquefaction unit can be incorporated into the cold recovery system 140 for fixed or stationary cold recovery systems 140 or alternatively a separate and independent liquefaction unit 300 can be used with cold recovery systems 140 that is portable such as a cold recovery system attached or installed within a vehicle. The liquefaction unit 300 is connected to the cold recovery system 140 through the first liquefaction unit valve 280 and the second liquefaction unit valve 282.

The hydrogen gas stream 110 is received from the gas source 110 and is initially compressed to about 100 bar via the at least one compressor 120. The hydrogen stream then enters the heat exchanger 130, which cools the hydrogen to about 27° C. The heat exchanger 130 is preferably a water-cooled heat exchanger; however, if desirable any suitable heat exchanger can be used.

In this example, the hydrogen stream enters the cold recovery system 140 having ten cold recovery vessels 150 ($CRV_{1-10}$) with the following cold recovery materials (CRM):

$CRM_1$: Solid water at −26.5° C.
$CRM_2$: Solid n-decane at −58° C.
$CRM_3$: Solid 1-methyl 4 ethyl benzene at −91° C.
$CRM_4$: Solid acetone at −110° C.
$CRM_5$: Solid ethanol at −126° C.
$CRM_6$: Solid n-pentane at −149° C.
$CRM_7$: Solid 2-metil pentane at −183° C.
$CRM_8$: Solid propylen at −190° C.
$CRM_9$: Solid Argon at −213° C.
$CRM_{10}$: Solid Nitrogen at −246° C.

An eleventh cold recovery vessel is used to cool the recycled gas used in the independent stationary liquefaction unit 300. The eleventh cold recovery vessel utilizes Solid Nitrogen at about −246° C.

In the first cold recovery vessel $\mathbf{150}_1$ ($CRV_1$) the water reduces the temperature of the hydrogen to about 4° C., and after the second cold recovery vessel $\mathbf{150}_2$ ($CRV_2$) the temperature of the hydrogen is about −26° C. The hydrogen passes through the third cold recovery vessel $\mathbf{150}_3$ ($CRV_3$) where the temperature reaches −58° C. The hydrogen stream is then expanded in a first turbine 310, which cools the hydrogen gas stream to about −70° C. and a pressure of about 80 bar (Steps A–B of FIG. 7). The first turbine 310 preferably includes a generator 311 or other suitable device configured to utilize the energy from the turbine 310.

The hydrogen continues through a series of cold recovery vessels $\mathbf{150}_{4-7}$ ($CRV_{4-7}$) wherein the temperature of the hydrogen is reduced to −88, −103, −124, and −149° C., respectively. A second turbine 330 expands the hydrogen gas stream, which results in the pressure of the gas stream going from about 80 bar to about 60 bar (Steps C–D of FIG. 7). The second turbine 330 also preferably includes a generator 331 or other suitable device configured to utilize the energy from the turbine 330.

The hydrogen gas stream then enter a series of three addition cold recovery vessels $\mathbf{150}_{8-10}$ ($CRV_{8-10}$) where the temperature of the hydrogen stream is cooled to about −168° C., −183° C., −188° C., respectively.

As shown in FIG. 7 (Steps E–F), the hydrogen gas stream then enters a third turbine 360 in the independent stationary liquefaction unit 300, where the pressure of the hydrogen gas stream drops from about 60 to about 10 bar. The third turbine includes a generator 361 or other suitable device configured to utilize the energy from the turbine 360. The gas stream enters the condenser 352 through an expansion valve 380 where the pressure of the gas stream is reduced to about 6.9 bar. The gas stream is then condensed in a liquefaction condenser 352. The gas stream returns to the cold recovery system 140 where it is stored in the storage tank 160.

At the end of the storage process the temperature of the cold recovery vessels have been increased to:

$CRV_1$: 22° C.
$CRV_2$: −1° C.
$CRV_3$: −37° C.
$CRV_4$: −75° C.
$CRV_5$: −93° C.
CRV6: −108° C.
CRV7: −129° C.
CRV8: −163° C.
CRV9: −183° C.
CRV10: −193° C.
CRV11: −193° C.

Because of the conversion of the ortho to para hydrogen and the heat leaks of the system 19% of the hydrogen vaporizes.

Once the service valve 196 is opened the liquid hydrogen gas stream begins to vaporize and cools the cold recovery materials (CRM) as the gas stream is released from the storage tank 160. The gas stream continues passing through the cold recovery system 140, where the gas stream vaporizes through the pipe 154 and cools the cold recovery material 152 of the ten cold recovery vessels ($CRV_{1-10}$).

The recycle gas stream exits the recycle gas tank 315 and is compressed in the recycle compressor 340 to a pressure of about 40 bar. The recycle gas stream then is cooled in the first of at least three heat exchangers 342 to about 27° C. The recycle gas stream then enters the second of the at least three heat exchangers 344 where the temperature of the recycle gas stream is reduced to about −187° C. In this embodiment, the recycle gas of the at least one independent stationary liquefaction unit 300 is hydrogen. However, any suitable gas can be used.

At this point the recycle gas stream is send to the eleventh cold recovery vessel ($CR_{11}$) through the first liquefaction unit valve 280 where the temperature reduces to −209° C. The recycle gas stream then returns to the independent stationary liquefaction unit 300 through the second liquefaction unit valve 282 where the recycle gas stream enters a third of the at least three heat exchangers 346, where the recycle gas stream is cooled to −218° C. The recycle gas stream then enters to the at least one gas recycle turbine 348 where the pressure drops to 5 bar. The at least one gas recycle turbine 348 also preferably includes a generator 349 or other suitable device configured to utilize the energy from the turbine 348.

At this point the recycle gas stream enters the at least one recycle gas expansion valve 350 where the pressure of the gas stream is reduced to 1.6 bar and its temperature to −250° C., which is preferably sufficient to liquefy the recycle gas stream in the condenser 352. The recycle gas stream then returns to the recycle gas tank 315 passing through a pair of heat exchangers 346, 344.

EXAMPLE 4

In example 4, a second process for liquefying hydrogen is shown. In this example, as observed in FIG. 8, the process 100 includes at least one compressor 120, at least one heat exchanger 130, and a cold recovery system 140 (CRS) including a plurality of cold recovery vessels 150, at least one turbine 260, and a storage tank 160. The process also includes at least one independent stationary liquefaction unit 300 as described in Example 3.

The hydrogen is initially compressed and cooled to about 27° C. and about 20 Bar. The hydrogen gas stream enters the cold recovery system 140 having nine cold recovery vessels 150 with the following cold recovery materials:

$CRM_1$: Solid water at −45° C.
$CRM_2$: Solid n-nonane at −84° C.
$CRM_3$: Solid acetone at −135° C.
$CRM_4$: Solid n-butane at −189° C.
$CRM_5$: Solid 2-methyl pentane at −163° C.
$CRM_6$: Solid 1-penten at −183° C.
$CRM_7$: Solid propylen at −190° C.
$CRM_8$: Solid Argon at −208° C.
$CRM_9$: Solid Nitrogen at −239° C.
$CRM_{10}$: Solid Nitrogen at −239° C.

The tenth cold recovery vessel is used to cool the gas stream (or recycled gas stream) as the liquefied hydrogen is released from the storage tank 160 and used in the independent stationary liquefaction unit 300.

In the first cold recovery vessel $\mathbf{150}_1$ ($CRV_1$) the water reduces the temperature of the hydrogen to about −2° C., and after the second cold recovery vessel $\mathbf{150}_2$ ($CRV_2$) the temperature of the hydrogen is about −39° C. The hydrogen passes through the third cold recovery vessel $\mathbf{150}_3$ ($CRV_3$) where the temperature reaches −84° C. The hydrogen continues through a series of cold recovery vessels $\mathbf{150}_{4-7}$ ($CRV_{4-7}$) wherein the temperature of the hydrogen is reduced to −132, −147, −162, and −172° C., respectively. The hydrogen gas stream then enters a series of two addition cold recovery vessels $\mathbf{150}_{8-9}$ ($CRV_{8-9}$) where the temperature of the hydrogen stream is cooled to −188 and −205° C., respectively. The hydrogen stream then enters a to an expansion valve 192 wherein the pressure reduces to 6.9 bar.

Figure 9:
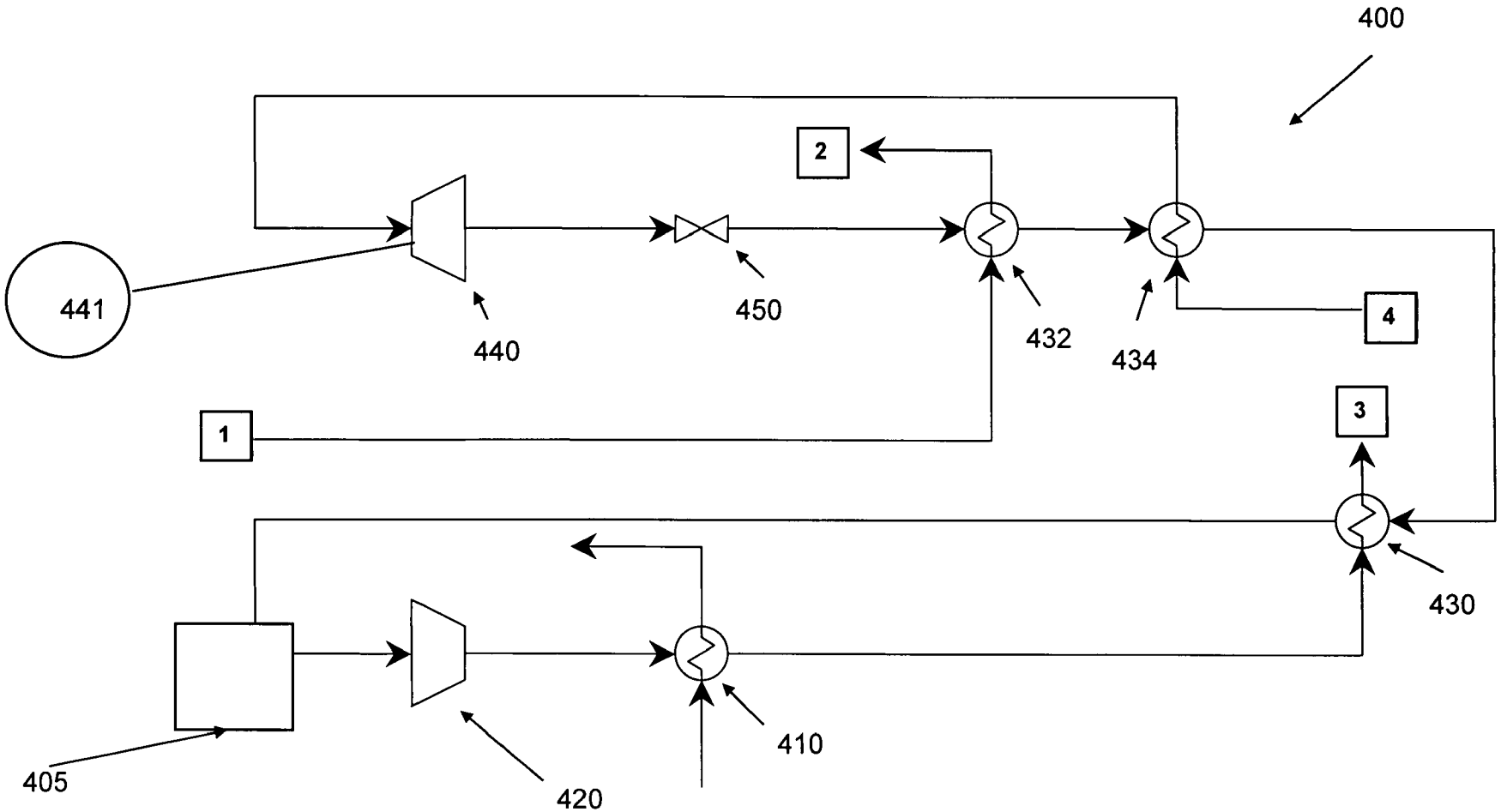
FIG. 9 shows a schematic flow diagram of the stationary liquefaction unit to be used in the alternative embodiment of the FIG. 8.

The gas stream is then sent to an independent stationary liquefaction unit 400 as shown in FIG. 9. As shown in FIG. 9, the gas stream enters a liquefaction condenser 432 where it is liquefied (Steps 1–2 of FIG. 9). After liquefaction of the gas stream, the liquefied gas stream leaves the liquefaction unit 400 and is stored in the storage tank 160.

At the end of the storage process the temperature of the cold recovery vessels have been increased to:

$CRV_1$: 22° C.
$CRV_2$: −7° C.
$CRV_3$: −51° C.
$CRV_4$: −99° C.
$CRV_5$: −138° C.
$CRV_6$: −162° C.
$CRV_7$: −163° C.
$CRV_8$: −183° C.
$CRV_9$: −198° C.
$CRV_{10}$: −198° C.

Because of the conversion of the ortho to para hydrogen and the heat leaks of the system 19% of the hydrogen vaporizes.

The independent stationary liquefaction unit 400 includes a recycle gas storage tank 405, a compressor 420, at least three heat exchangers 410, 430, 434, a recycle gas turbine 440, an expansion valve 450 and the liquefaction condenser 432.

During the storing stage, the stationary liquefaction unit 400 receives the recycle gas from the recycle gas storage tank 405 and compresses the recycle gas in the recycle compressor 420 to a pressure of about 40 bar. The recycle compressor 420 can be a single or multistage recycle compressor. The recycled gas stream is then cooled in the first of the at least three heat exchangers 410 to about 27° C. The recycled gas stream then enters the second of the three heat exchangers 430 where the temperature of the recycled gas stream is reduced to about −196° C. At this point the recycle gas stream is send to the tenth cold recovery vessel $\mathbf{150}_{10}$ ($CRV_{10}$) through the first liquefaction unit valve 280 of the cold recovery system 140 where the temperature of the gas stream is reduced to about −207° C.

The recycle gas stream then returns to the independent stationary liquefaction unit 400 through a second liquefaction valve 282 where the gas stream enters the third of the three heat exchangers 434. In the third of the at least three heat exchangers 434, the recycle gas stream is cooled to −218° C. The recycled gas stream then enters the at least one recycle turbine 440 where the pressure drops to 5 bar. At this point the recycled gas stream enters an expansion valve 450 where the pressure is reduced to 1.6 bar and its temperature to about −250° C, which liquefies the gas stream in the condenser 432. The recycle gas then returns to the recycle gas tank 405 passing through two of the at least three heat exchangers 434, 430.

Figure 8:
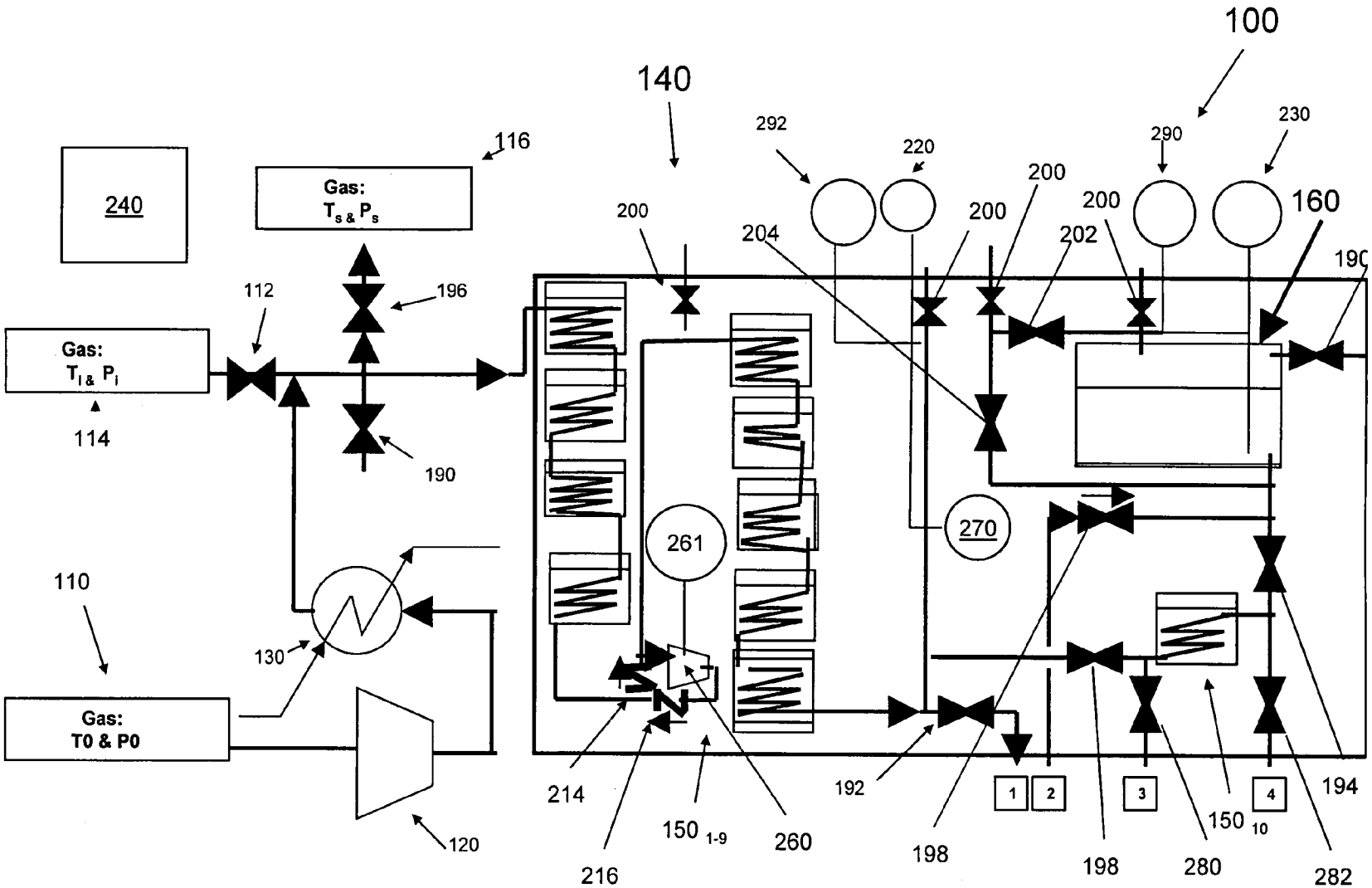
FIG. 8 shows a schematic flow diagram of a process to store hydrogen gas in liquid form according to an alternative embodiment.

Once the service valve 196 is opened the liquid hydrogen gas stream begins to vaporize and cool the cold recovery materials. As shown in FIG. 8 between the fourth and fifth cold recovery vessels ($CRV_{4-5}$), the gas passes through the first of the at least one turbine 260 where the pressure of the gas stream is reduced from about 6.9 bar to 1.6 bar which produces additional refrigeration. The at least one turbine 260 also preferably includes a generator 261 or other suitable device configured to utilize the energy from the at least one turbine 260.

Figure 10:
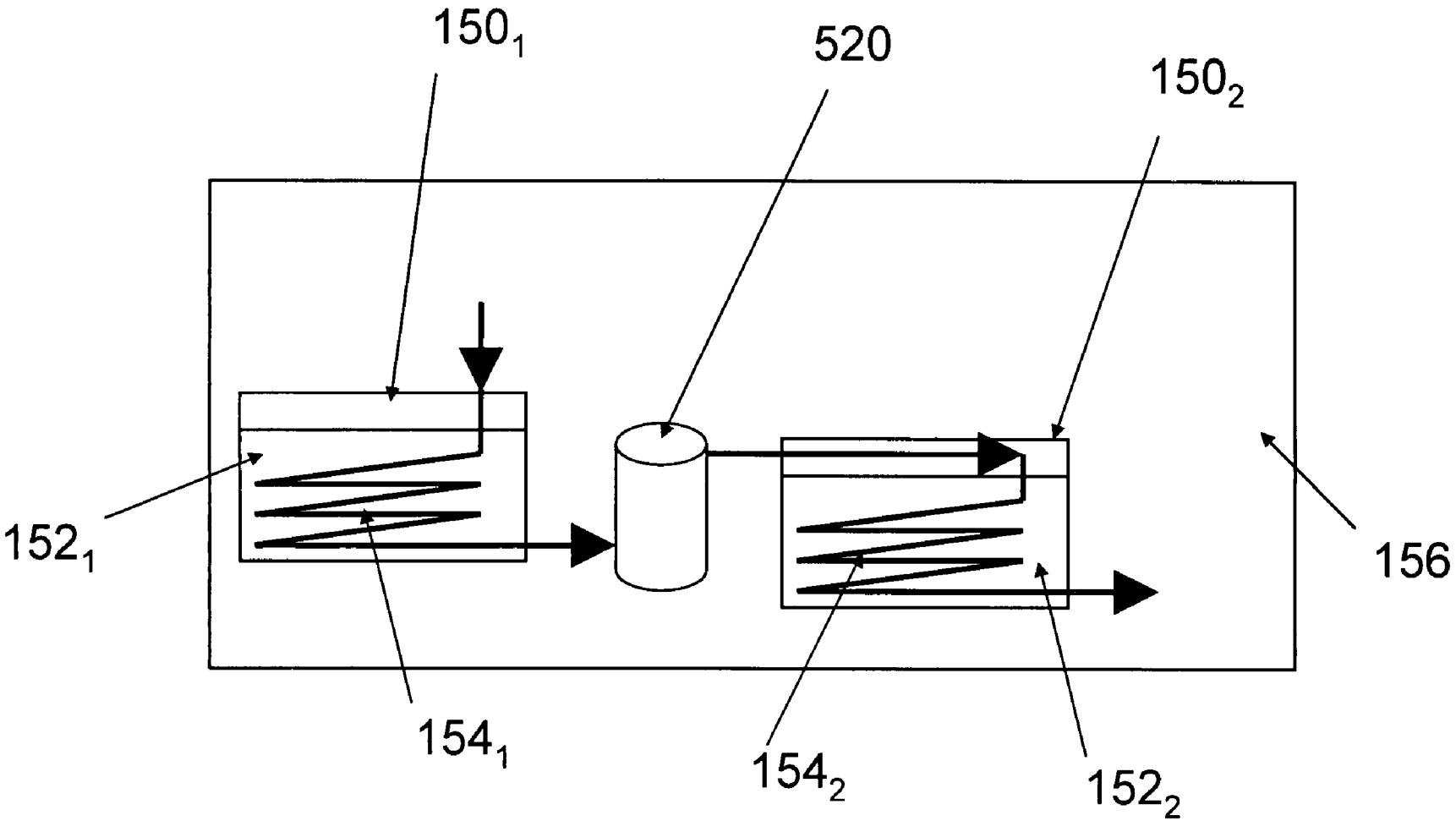
FIG. 10 shows a schematic flow diagram of a plurality of cold recovery vessel and an apparatus for removing contaminants from the gas stream.

FIG. 10 shows a schematic flow diagram of a plurality of cold recovery vessel and an apparatus for removing contaminants from the gas stream. The apparatus 520 is configured to remove contaminants or materials from the gas stream with a freezing point between the operating temperature of the two adjacent cold recovery vessels 150 in case to be necessary. The apparatus 520 can be a screen or other suitable material or device for removal of the contaminants.

It can be appreciated that the number of cold recovery vessels is needed is a function so several factors including:

The temperature of the gas exiting one cold recovery vessels during the storing step must be higher than the exiting temperature of the same cold recovery vessel during the consumption step.

A heat balance of the $CRV_i$ will give the exit temperature of the $CRV_{i-1}$ during the storing step ($TS_{2CRVi-1}$). The exit temperature of the $CRV_{i-1}$ during the consumption step ($TC_{2CRVi-1}$) must be lower than $TS_{2CRVi-1}$. The first cold recovery vessel ($CRV_1$) will be reached when the inlet temperature of this vessel ($TS1_{CRV1}$) will be equal to the inlet temperature of the cold recovery system.

In order to choose the adequate cold recovery material it is necessary to take in account the following issues:

The average temperature of the cold recovery material of the cold recovery vessel has to be higher than the average exiting temperature gas during the consumption step in the cold recovery vessel and lower than the average exiting temperature gas during the storing step, so it is a good guideline that the melting point of the cold recovery material (CRM) be close to the average temperature of the stream gas exiting a determined cold recovery vessel in the both consumption and storage.

In addition, because of risk of leaks in the system, it is desirable that the cold recovery material be compatible with the gases being stored.

In addition, it is desirable that the last cold recovery vessel has a cold recovery material with a melting point between the equilibrium temperature of the gas saturated at the storage pressure and the equilibrium temperature of the gas at the pressure after the expansion valve. In order words the melting point of the cold recovery material has to be between the temperature of the gas in the storage tank and the temperature of the gas after it is expanded in the expansion valve.

Examples 1–4 are only a few examples of gases (i.e. methane and hydrogen) that the system and process as described herein can be used to reduce the operating cost of storing gases.

In addition, the difference between the initial pressure and the service pressure using in this examples could be different depending of the consumption rate of the gas to be stored. Accordingly, it should be appreciated that the conditions as set forth in the examples can be changed such that the conditions should not be considered as a fixed operating condition.

The method and system preferably can be used for industrial, commercial, vehicles or personnel applications. In addition, it is desirable that the system is of a size that is portable, including mounting the system in a vehicle or in small room.

The system can be particularly useful to store liquefied natural gas taken directly from a local natural gas distribution line with a compressor. Alternatively, the system can be used to store liquefied natural gas taken directly from a high-pressure transportation line.

In addition although the present invention has been described in process at low temperature it will be appreciated by those skilled in the art that the same process could be used to recover heat instead of the refrigeration in industrial units as heaters, boilers, furnaces, etc where the stream gas doesn't need to be stored. In such cases, the cold recovery vessels could be used to recover the energy delivery by the units during the shut-down step in order that the cold recovery vessels are used to heat these units later during the start up of the units instead of using fuels or any other external energy.

Although the present invention has been described in connection with preferred embodiments thereof, it will be appreciated by those skilled in the art that additions, deletions, modifications, and substitutions not specifically described can be made without departing from the spirit and scope of the invention as defined in the appended claims.

What is claimed is:

1. A system for storing gases at low temperature, the system comprising:

a compressor configured to receive a gas stream and produce a compressed gas stream;

a heat exchanger configured to receive the compressed gas stream and produce a cooled gas stream; and an insulated cold recovery system configured to receive the cooled gas stream from the heat exchanger, the insulated cold recovery system comprising:

at least one cold recovery vessel configured to receive the cooled gas stream, the cold recovery vessel comprising a cold recovery material configured to cool the cooled gas stream, wherein the cooled gas stream is fed through the cold recovery vessel in a pipe immersed in the cold recovery material to produce a liquefied or low temperature gas;

a first expansion valve configured to receive the cooled gas stream and reduce a pressure of the cooled gas stream to a storage pressure; and at least one storage tank configured to receive the liquefied or low temperature gas from the first expansion valve and store the liquefied or low temperature gas in a liquid or low temperature state, wherein when the liquefied or low temperature gas is released from the storage tank, the liquefied vaporizes or low temperature gas expands in the pipe and cools the cold recovery material.

2. The system of claim 1, wherein system includes at least two cold recovery vessels, each of the at least two cold recovery vessels comprising a cold recovery material having different physical properties.

3. The system of claim 2, wherein the first expansion valve is positioned between a last cold recovery vessel and the storage tank, the first expansion valve configured to receive the cooled gas stream from the last cold recovery vessel and deliver the liquefied or low temperature gas to the storage tank.

4. The system of claim 3, wherein the first expansion valve is designed to open when a pressure of the cooled gas stream in the pipe reaches about an initial pressure of the gas stream.

5. The system of claim 3, further comprising a second expansion valve positioned between a last cold recovery vessel and the storage tank, the second expansion valve configured to receive the liquefied or low temperature gas from the storage tank and deliver the liquefied or low temperature gas to the pipe.

6. The system of claim 5, wherein the second expansion valve is designed to open when a pressure of the liquefied or low temperature gas in the pipe is slightly lower than a service pressure of the gas stream.

7. The system of claim 1, further comprising a service valve, the service valve configured to deliver the liquefied or low temperature gas to an end user, wherein the service valve causes a pressure drop in the pipe which closes the first expansion valve and opens the second expansion valve as the stored liquefied or low temperature gas starts leaving the storage tank.

8. The system of claim 1, wherein the cold recovery material is selected based on an average operating temperature of the gas exiting to the cold recovery vessel in both storing and consumption stages, and the heat transport properties of the cold recovery material, the heat transport properties of the cold recovery material comprising melting point, latent heat of fusion, and specific heat and thermal conductivity in both liquid and solid state.

9. The system of claim 8, wherein the cold recovery material is a pure or a mixture of materials as acetic acid, water, ethylenglicol, n-decane, n-octane, acetone, 1 methyl 4 ethyl benzene, n-pentane, 2 methyl pentane, propylene, argon, nitrogen, ethanol, or any other suitable material for cooling of a gas such as oxygen, nitrogen, ethane, methane, hydrogen, helium or any other pure gas or mixture thereof.

10. The system of claim 9, wherein the cold recovery material further comprises an anti-freezing additive to adjust a physical property of the cold recovery material.

11. The system of claim 1, wherein the insulated cold recovery system is configured to fit within a vehicle.

12. A system for liquefaction of natural gas, the system comprising:

a compressor configured to receive a gas stream and produce a compressed gas stream;

a heat exchanger configured to receive the compressed gas stream and produce a cooled gas stream; and an insulated cold recovery system configured to receive the cooled gas stream from the heat exchanger, the insulated cold recovery system comprising:

a plurality of cold recovery vessels, each of the plurality of cold recovery vessels comprising a cold recovery material configured to cool the cooled gas stream, wherein the cooled gas stream is fed through the cold recovery vessel in a pipe immersed in the cold recovery material;

a first expansion valve positioned and configured to receive the cooled gas stream from the plurality of cold recovery vessels;

a final cold recovery vessel positioned and configured to receive the cooled gas stream from the first expansion valve and liquefy the cooled gas stream into a liquid state;

a second expansion valve positioned and configured to receive the cooled gas stream from the final cold recovery vessel; and at least one storage tank configured to receive the liquefied gas and store the liquefied gas in the liquid state, wherein the liquefied gas stream vaporizes through the second expansion valve and passes through the pipe and cools the cold recovery material of each of the plurality of cold recovery vessels.

13. The system of claim 12, wherein the insulated cold recovery system includes a third expansion valve positioned and configured to receive the liquefied gas in a gas phase from the storage tank when the pressure of the storage tank reaches a maximum allowable working pressure.

14. The system of claim 13, wherein the insulated cold recovery system includes a fourth expansion valve positioned and configured to receive the gas phase from the third expansion valve, wherein the fourth expansion valve expands the gas phase and delivers the gas phase to the last cold recovery vessel.

15. The system of claim 12, wherein the natural gas is hydrogen.

16. The system of claim 12, wherein the insulated cold recovery system further includes at least one turbine, the at least one turbine configured to reduce a pressure of the liquefied gas during the vaporization of the liquefied gas.

17. The system of claim 12, wherein the cold recovery system further includes at least one turbine, the at least one turbine configured to reduce a pressure of the cooled gas stream during liquefaction of the cooled gas stream.

18. The system of claim 12, further comprising an automatic control device configured to control the first and the second expansion valves.

19. The system of claim 12, wherein the insulated cold recovery system is configured to fit within a vehicle.

20. A system for liquefaction of gases, the system comprising:

a compressor configured to receive a gas stream and produce a compressed gas stream;

a heat exchanger configured to receive the compressed gas stream and produce a cooled gas stream; and an insulated cold recovery system configured to receive the cooled gas stream from the heat exchanger, the insulated cold recovery system comprising:

a plurality of cold recovery vessels, each of the plurality of cold recovery vessels comprising a cold recovery material configured to cool the cooled gas stream, wherein the cooled gas stream is fed through the cold recovery vessel in a pipe immersed in the cold recovery material to produce a liquefied gas;

at least one by-pass valve configured to route the cooled gas stream through or around a selected cold recovery vessel;

at least one turbine configured to expand and cool the cooled gas stream during the vaporization of the gas stream, the at least one turbine positioned between the plurality of cold recovery vessels;

an independent stationary liquefaction unit positioned between the plurality of cold recovery vessels and at least one storage tank, wherein the liquefaction unit is configured to liquefy the cooled gas stream into a liquefied gas stream; and at least one storage tank configured to receive the liquefied gas stream from the independent liquefaction unit and store the liquefied gas stream in a liquid state, and wherein the liquefied gas stream vaporizes through a pipe and cools the cold recovery material of the cold recovery vessel before expanding in the at least one turbine and cooling the cold recovery material of the plurality of cold recovery vessels.

21. The system of claim 20, wherein the liquefaction unit comprises a condenser configured to receive the gas from a first connection and condense the cooled gas stream into the liquefied gas stream.

22. The system of claim 20, wherein the liquefaction unit comprises at least one recycle compressor configured to receive a recycle gas stream and produce a compressed recycled gas stream.

23. The system of claim 22, wherein the at least one recycle compressor is a single or multistage recycle compressor.

24. The system of claim 20, wherein the liquefaction unit comprises at least three heat exchangers configured to receive the recycle gas stream and reduce a temperature of the recycle gas stream.

25. The system of claim 20, wherein the liquefaction unit comprises at least one expansion valve, the at least one expansion valve configured to reduce a temperature and a pressure of the recycle gas stream after a turbine.

26. The system of claim 20, wherein the liquefaction unit comprises at least one recycle gas turbine configured to receive the recycle gas stream from at least one of the at least three heat exchangers and expand the recycle gas stream which reduces a temperature of the recycle gas stream.

27. The system of claim 20, further comprising an automatic control device configured to control the at least one expansion valve.

28. The system of claim 20, wherein the insulated cold recovery system is configured to fit within a vehicle.

29. A process for storing gases at low temperatures using a cold recovery system comprising:

compressing a gas stream in a compressor to form a compressed gas;

passing the compressed gas stream through a heat exchanger to form a cooled gas stream;

cooling the cooled gas stream in an insulated cold recovery system, the insulated cold recovery system comprising:

at least one cold recovery vessel configured to receive the cooled gas stream, the cold recovery vessel comprising a cold recovery material configured to liquefy the cooled gas stream, wherein the cooled gas stream is fed through the cold recovery vessel in a pipe immersed in the cold recovery material to produce a liquefied gas;

at least one expansion valve, the at least one expansion valve configured to reduce a pressure of the cooled gas stream; and at least one storage tank configured to receive and store the liquefied gas;

storing the liquefied gas in a liquid state in the at least one storage tank; and vaporizing the liquefied gas from the storage tank of the cold recovery system through the at least one cold recovery vessel, wherein the vaporization of the gas stream cools the cold recovery material.

30. The process of claim 29, further comprising injecting a cryogenic liquid such as helium, nitrogen, argon or refrigerants such as ammonia, Freon, carbon dioxide into the cold recovery vessels to cool the cold recovery material before cooling the cooled gas stream in the insulated cold recovery system.

31. An insulated cold recovery system used to recover the refrigeration existing when a gas is stored at low temperature comprising:

at least one cold recovery vessel configured to receive a gas stream from a gas source, the cold recovery vessel comprising a cold recovery material configured to reduce the temperature of the gas stream, wherein the gas stream is fed through the cold recovery vessel in a pipe immersed in the cold recovery material to produce a liquefied or low temperature gas;

an expansion valve configured to receive the gas stream and reduce a pressure of the gas stream to a storage pressure; and at least one storage tank configured to receive the liquefied or low temperature gas from the expansion valve and store the liquefied or low temperature gas in a liquid or low temperature state, wherein when the liquefied or low temperature gas is released from the insulated cold recovery system, the liquefied or low temperature gas vaporizes or expands through the pipe and cools the cold recovery material.

32. The system of claim 31, wherein system includes at least two cold recovery vessels, each of the at least two cold recovery vessels comprising a cold recovery material having different physical properties.

33. The system of claim 32, wherein the first expansion valve is positioned between a last cold recovery vessel and the storage tank, the first expansion valve configured to receive the cooled gas stream from the last cold recovery vessel and deliver the liquefied or low temperature gas to the storage tank.

34. The system of claim 33, further comprising a second expansion valve positioned between a last cold recovery vessel and the storage tank, the second expansion valve configured to receive the liquefied or low temperature gas from the storage tank and deliver the liquefied or low temperature gas to the pipe.

35. The system of claim 31, further comprising a service valve, the service valve configured to deliver the liquefied or low temperature gas to an end user, wherein the service valve causes a pressure drop in the pipe which closes the first expansion valve and opens the second expansion valve as the stored liquefied or low temperature gas starts leaving the storage tank.

36. The system of claim 31, wherein the cold recovery material is selected based on an average operating temperature of the gas exiting to the cold recovery vessel in both storing and consumption stages, and the heat transport properties of the cold recovery material, the heat transport properties of the cold recovery material comprising melting point, latent heat of fusion, and specific heat and thermal conductivity in both liquid and solid state.

37. The system of claim 31, wherein the insulated cold recovery system is configured to fit within a vehicle.

38. A system for liquefaction of natural gas, the system comprising:

a compressor configured to receive a gas stream and produce a compressed gas stream;

a heat exchanger configured to receive the compressed gas stream and produce a cooled gas stream; and an insulated cold recovery system configured to receive the cooled gas stream from the heat exchanger, the insulated cold recovery system comprising:

a plurality of cold recovery vessels, each of the plurality of cold recovery vessels comprising a cold recovery material configured to cool the cooled gas stream, wherein the cooled gas stream is fed through the cold recovery vessel in a pipe immersed in the cold recovery material to produce a liquefied gas;

at least one contamination removal apparatus configured to remove contaminants from the cooled gas stream, wherein the at least one contaminant removal apparatus is positioned between two of the plurality of cold recovery vessels;

a first expansion valve positioned and configured to receive the cooled gas stream from the plurality of cold recovery vessels;

a final cold recovery vessel positioned and configured to receive the cooled gas stream from the first expansion valve;

a second expansion valve positioned and configured to receive the cooled gas stream from the final cold recovery vessel and liquefy the cooled gas stream into a liquid state; and at least one storage tank configured to receive the liquefied gas and store the gas in the liquid state, wherein the liquefied gas vaporizes through the second expansion valve and passes through the pipe and cools the cold recovery material of each of the plurality of cold recovery vessels.

39. The system of claim 38, wherein system includes at least two cold recovery vessels, each of the at least two cold recovery vessels comprising a cold recovery material having different physical properties.

40. The system of claim 38, further comprising a service valve, the service valve configured to deliver the liquefied gas to an end user, wherein the service valve causes a pressure drop in the pipe which closes the first expansion valve and opens the second expansion valve as the stored liquefied gas starts leaving the storage tank.

41. The system of claim 38, wherein the cold recovery material is selected based on an average operating temperature of the gas exiting to the cold recovery vessel in both storing and consumption stages, and the heat transport properties of the cold recovery material, the heat transport properties of the cold recovery material comprising melting point, latent heat of fusion, and specific heat, and thermal conductivity in both liquid and solid state.

42. A system for liquefaction of gases, the system comprising:

a compressor configured to receive a gas stream and produce a compressed gas stream;

a heat exchanger configured to receive the compressed gas stream and produce a cooled gas stream; and an insulated cold recovery system configured to receive the cooled gas stream from the heat exchanger, the insulated cold recovery system comprising:

a plurality of cold recovery vessels, each of the plurality of cold recovery vessels comprising a cold recovery material configured to cool the cooled gas stream, wherein the cooled gas stream is fed through the cold recovery vessel in a pipe immersed in the cold recovery material to produce a liquefied gas;

at least one by-pass valve configured to route the cooled gas stream through or around a selected cold recovery vessel; at least one turbine configured to expand and cool the cooled gas stream during the liquefaction of the gas stream, the at least one turbine positioned between the plurality of cold recovery vessels;

an independent stationary liquefaction unit position between the plurality of cold recovery vessels and at least one storage tank, wherein the liquefaction unit is configured to liquefy the cooled gas stream into a liquefied gas stream; and at least one storage tank configured to receive the liquefied gas stream from the independent liquefaction unit and store the liquefied gas stream in a liquid state, and wherein the liquefied gas stream vaporizes through a pipe and cools the cold recovery material of the plurality of cold recovery vessels.

* * * * *

UNITED STATES PATENT AND TRADEMARK OFFICE

CERTIFICATE OF CORRECTION

PATENT NO. : 7,024,885 B2
APPLICATION NO. : 10/778808
DATED : April 11, 2006
INVENTOR(S) : Carlos Eduardo Roldan It is certified that error appears in the above-identified patent and that said Letters Patent is hereby corrected as shown below:

On Title Page, Col. 1 Item (56), please delete "2,147,109" and insert --2,148,109--.

Signed and Sealed this

Eleventh Day of July, 2006

JON W. DUDAS
*Director of the United States Patent and Trademark Office*